US009081360B2

(12) United States Patent
Ishida

(10) Patent No.: US 9,081,360 B2
(45) Date of Patent: Jul. 14, 2015

(54) IMAGE FORMATION APPARATUS

(71) Applicant: Konica Minolta, Inc., Chiyoda-ku (JP)

(72) Inventor: Hirofumi Ishida, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/331,675

(22) Filed: Jul. 15, 2014

(65) Prior Publication Data

US 2015/0023676 A1 Jan. 22, 2015

(30) Foreign Application Priority Data

Jul. 17, 2013 (JP) ..... 2013-148394

(51) Int. Cl.
*G03G 15/00* (2006.01)
*G03G 21/20* (2006.01)

(52) U.S. Cl.
CPC ..... *G03G 21/20* (2013.01); *G03G 15/50* (2013.01)

(58) Field of Classification Search
CPC . G03G 21/20; G03G 15/1675; G03G 15/161; G03G 15/0189; G03G 15/50
USPC ..... 399/44, 68
See application file for complete search history.

(56) References Cited

U.S. PATENT DOCUMENTS

2014/0168704 A1* 6/2014 Hasegawa ..... 358/1.15
2014/0301758 A1* 10/2014 Kim et al. ..... 399/301

FOREIGN PATENT DOCUMENTS

JP 2004-045661 A 2/2004
JP 2005-055624 A 3/2005
JP 2007-259466 A 10/2007
JP 2013-007813 A 1/2013
JP 2013-074495 A 4/2013

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An image formation apparatus applies electrical charge to an image carrier surface of a photosensitive body during a period between light exposure scanning for successive pages, and performs a first control such that rotation distance of the photosensitive body during the period is shorter than circumferential length thereof. The image formation apparatus includes a coverage calculation unit that calculates coverage of a target page, a prediction unit that, when inter-image distance between images of the target page and a next page, in terms of a sub-scanning direction, is shorter than the circumferential length, predicts whether image noise will occur for the next page based on the coverage, and a sheet interval control unit that, upon the prediction unit predicting affirmatively, suspends the first control and performs a second control on the rotation distance such that the inter-image distance is extended to be at least as long as the circumferential length.

11 Claims, 15 Drawing Sheets

FIG. 6A

| Cumulative number of printed sheets: 0 | | Coverage P (%) | | | | |
|---|---|---|---|---|---|---|
| | | 20 | 40 | 60 | 80 | 100 |
| Absolute humidity N ($g/m^3$) | 14 | No | No | No | No | 6 |
| | 12 | No | No | No | 10 | 5 |
| | 9 | No | No | No | 8 | 4 |
| | 6 | No | No | 8 | 4 | 4 |
| | 3 | No | 10 | 5 | 2 | 1 |

FIG. 6B

| Cumulative number of printed sheets: 3000 | | Coverage P (%) | | | | |
|---|---|---|---|---|---|---|
| | | 20 | 40 | 60 | 80 | 100 |
| Absolute humidity N ($g/m^3$) | 14 | No | No | No | No | No |
| | 12 | No | No | No | No | No |
| | 9 | No | No | No | No | No |
| | 6 | No | No | No | 11 | 7 |
| | 3 | No | No | 10 | 6 | 3 |

FIG. 6C

| Cumulative number of printed sheets: 5000 | | Coverage P (%) | | | | |
|---|---|---|---|---|---|---|
| | | 20 | 40 | 60 | 80 | 100 |
| Absolute humidity N ($g/m^3$) | 14 | No | No | No | No | No |
| | 12 | No | No | No | No | No |
| | 9 | No | No | No | No | No |
| | 6 | No | No | No | No | No |
| | 3 | No | No | No | No | No |

FIG. 7A

| Cumulative number of printed sheets: 0-2999 | | Coverage P (%) | | | | |
|---|---|---|---|---|---|---|
| | | P<40 | 40≤P<60 | 60≤P<80 | 80≤P<100 | P=100 |
| Absolute humidity N (g/m³) | 12<N≤14 | No | No | No | No | ⑥ |
| | 9<N≤12 | No | No | No | ⑩ | ⑤ |
| | 6<N≤9 | No | No | No | ⑧ | ④ |
| | 3<N≤6 | No | No | ⑧ | ④ | ④ |
| | N≤3 | No | ⑩ | ⑤ | ② | ① |

FIG. 7B

| Cumulative number of printed sheets: 3000-4999 | | Coverage P (%) | | | | |
|---|---|---|---|---|---|---|
| | | P<40 | 40≤P≤60 | 60≤P≤80 | 80≤P<100 | P=100 |
| Absolute humidity N (g/m³) | 12<N≤14 | No | No | No | No | No |
| | 9<N≤12 | No | No | No | No | No |
| | 6<N≤9 | No | No | No | No | No |
| | 3<N≤6 | No | No | No | ⑪ | ⑦ |
| | N≤3 | No | No | ⑩ | ⑥ | ③ |

IMAGE FORMATION APPARATUS

CROSS-REFERENCE TO RELATED APPLICATION

This application is based on an application No. 2013-148394 filed in Japan, the contents of which are hereby incorporated by reference.

BACKGROUND OF THE INVENTION (1) Field of the Invention

The present invention relates to an image formation apparatus such as a printer or a photocopier, and in particular relates to an art of, during an image formation operation, removing residual electrical charge accumulated in a photosensitive body.

(2) Description of the Related Art

In terms of image formation apparatuses using an electrophotographic process, in recent years it has become common to use an image formation apparatus which includes a photosensitive body having a protective layer formed at an outer most surface thereof in order to improve durability of the photosensitive body.

FIG. 16 is a cross-sectional diagram schematically illustrating one example of layer configuration of the aforementioned photosensitive body. As illustrated in FIG. 16, the photosensitive body includes a conductive substrate 3001 which is for example made of aluminum. The photosensitive body also includes an under-coat layer (UCL) 3002, a charge generation layer (CGL) 3003, a charge transport layer (CTL) 3004, and a protective layer 3005, layered in respective order on the conductive substrate 3001. The UCL 3002 is for example made of a resin, the CGL 3003 is for example made of a charge generating material and a resin, the CTL 3004 is for example made of a hole transport material and a resin, and the protective layer 3005 is for example made of a binder resin and inorganic fine particles.

In order to start image formation on the photosensitive body, a negative charge is applied to an outermost surface (i.e., an image carrier surface) of the photosensitive body, as illustrated in FIG. 16. The photosensitive body to which the negative charge has been applied is subsequently exposed to light indicated by dashed arrow A (note that only the leftmost dashed arrow in FIG. 16 is labeled using the reference sign A, whereas reference signs are omitted for other dashed arrows indicating the same). During the aforementioned light exposure, the CGL 3003 receives the light indicated by arrow A and generates, as a pair, a hole P (note that only a leftmost hole in FIG. 16 is labeled using the reference sign P, whereas reference signs are omitted for other holes) and an electron Q (note that only a leftmost electron in FIG. 16 is labeled using the reference sign Q, whereas reference signs are omitted for other electrons).

As illustrated by solid arrow B in FIG. 16 which points in an upward direction (note that only a leftmost solid arrow in FIG. 16 is labeled using the reference sign B, whereas reference signs are omitted for other solid arrows indicating the same), the hole P is attracted towards the negative charge at the outermost surface of the photosensitive body. As a consequence, the hole P moves through the CTL 3004 and the protective layer 3005 to reach the outermost surface of the photosensitive body, and neutralizes the negative charge at the outermost surface, causing formation of an electrostatic latent image. On the other hand, as illustrated by arrow C in FIG. 16 (note that only a leftmost solid arrow in FIG. 16 is labeled using the reference sign C, whereas reference signs are omitted for other solid arrows indicating the same), the electron Q is attracted towards a positive charge in the conductive substrate 3001. As a consequence, the electron Q moves through the UCL 3002 to reach the conductive substrate 3001.

Formation of the protective layer 3005 at the outermost surface of the photosensitive body as described above, improves resistance of the photosensitive body to abrasion, and thus improves durability of the photosensitive body by preventing the surface of the photosensitive body being worn away due to contact, for example with toner or a cleaning member.

However, experiments conducted by the inventors of the present application have confirmed that in a configuration such as described above, in which the protective layer 3005 is layered outward of the CGL 3003 and the CTL 3004, when the hole P moves towards the outermost surface of the photosensitive body, the hole P may become trapped at an interface between the CTL 3004 and the protective layer 3005 as illustrated by dashed circles in FIG. 16.

The trapped hole P eventually moves to the outermost surface of the photosensitive body as a result of repeated performance of image formation and thereby neutralizes negative charge at the outermost surface. As a consequence, an electrostatic latent image which is not related to image data is formed on the photosensitive body and when the electrostatic latent image is developed, image noise (i.e., a so called ghost image) occurs on a recording sheet which is undergoing a printing process.

In terms of an art for preventing the aforementioned image noise, Japanese Patent Application Publication No. 2013-7813 for example discloses an art of, during a period in which printing jobs are suspended, applying an electrical charge to an image carrier surface of a photosensitive body, while rotating the photosensitive body at least once, in order to remove residual charge (holes) trapped in the photosensitive body.

Through the art described above, it is possible to prevent image noise occurring even when an image formation operation is performed repeatedly.

Unfortunately, in the art described above, an operation of removing residual charge from the photosensitive body by applying electrical charge is performed while printing jobs are suspended. Therefore, the art described above suffers from a problem of being unable to prevent image noise, occurring due to accumulation of residual charge in the photosensitive body, during performance of an image formation operation. In consideration of the above problem, in order that the operation of removing residual charge described above is performed during the image formation operation, the removal operation could be performed in a period between successive recording sheets, which in other words corresponds to a period between completion of light exposure scanning based on image data of a preceding page and commencement of light exposure scanning based on image data of a next page after the preceding page. Unfortunately, in order to perform the removal operation during the aforementioned period, the period is required to be long enough for the photosensitive body to rotate once, resulting in a problem of reduced image formation productivity.

SUMMARY OF THE INVENTION

In order to achieve the objective described above, one aspect of the present invention is an image formation apparatus performing light exposure scanning based on image data of a target page, thereby forming a toner image on a charged image carrier surface of a photosensitive body, applying electrical charge to the image carrier surface, while rotating the photosensitive body, in order to remove residual charge from the photosensitive body, during a period between completion of the light exposure scanning and commencement of light exposure scanning based on image data of a next page, and performing a first control on rotation distance of a circumference of the photosensitive body during the period such that the rotation distance is a predetermined distance that is shorter than circumferential length of the photosensitive body, the image formation apparatus including: a coverage calculation unit configured to calculate, for the target page, a coverage value indicating surface area of a toner deposition region as a proportion of surface area of an image formation region of the target page; a prediction unit configured to, when an inter-image distance between a trailing end of an image of the target page in terms of a sub-scanning direction and a leading end of an image of the next page in terms of the sub-scanning direction is shorter than the circumferential length of the photosensitive body, perform a prediction as to whether or not image noise will occur in the image of the next page, based on the coverage value calculated for the target page; and a sheet interval control unit configured to, upon the prediction unit predicting that image noise will occur, suspend the first control and perform a second control on the rotation distance of the circumference of the photosensitive body during the period such that the inter-image distance is extended to be at least as long as the circumferential length of the photosensitive body.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIGS. 6A, 6B, and 6C each illustrate results from experiments conducted into relationship between coverage, absolute humidity, and image noise threshold value;

FIGS. 7A and 7B each illustrate a specific example of an image noise prediction table;

DESCRIPTION OF PREFERRED EMBODIMENTS

The following explains an image formation apparatus according to one embodiment of the present invention, using an example of a tandem color digital printer (herein, referred to simply as a printer).

1. Printer Configuration

Figure 1:
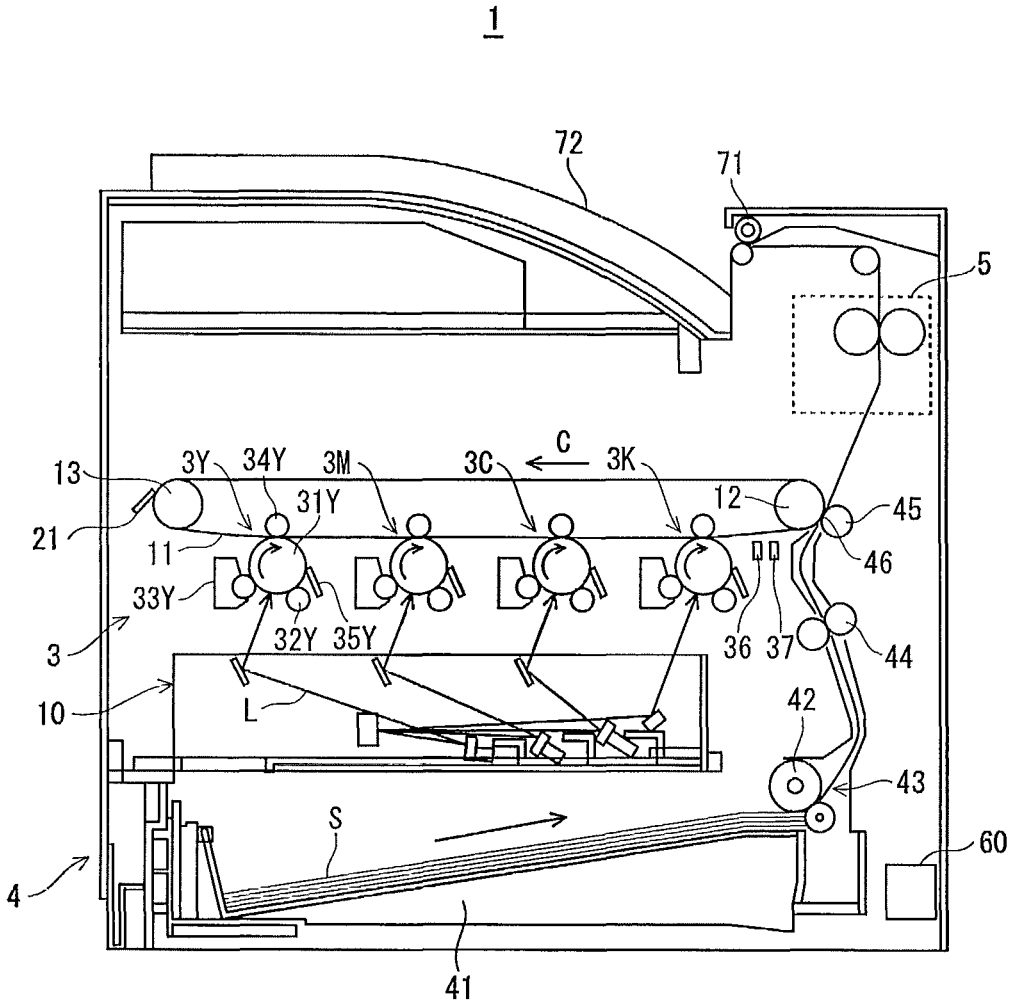
FIG. 1 illustrates configuration of a printer 1.

First explanation is provided of configuration of a printer 1 relating to the present embodiment. FIG. 1 illustrates configuration of the printer 1. As illustrated in FIG. 1, the printer 1 includes an image processing unit 3, a sheet feeder 4, a fixing device 5, and a controller 60.

The printer 1 is connected to a network such as a local area network (LAN). When the printer 1 receives a print command from an externally located terminal (not illustrated) or operation panel (not illustrated), the printer 1 performs a printing process on a recording sheet by forming respective toner images of yellow, magenta, cyan, and black colors based on the print command, and forming a full-color image by superimposed transfer of the toner images. Herein, the colors yellow, magenta, cyan, and black are represented by letters Y, M, C, and K respectively, and configuration elements related to each of the aforementioned colors are labeled with the letter representing the corresponding color.

Figure 2:
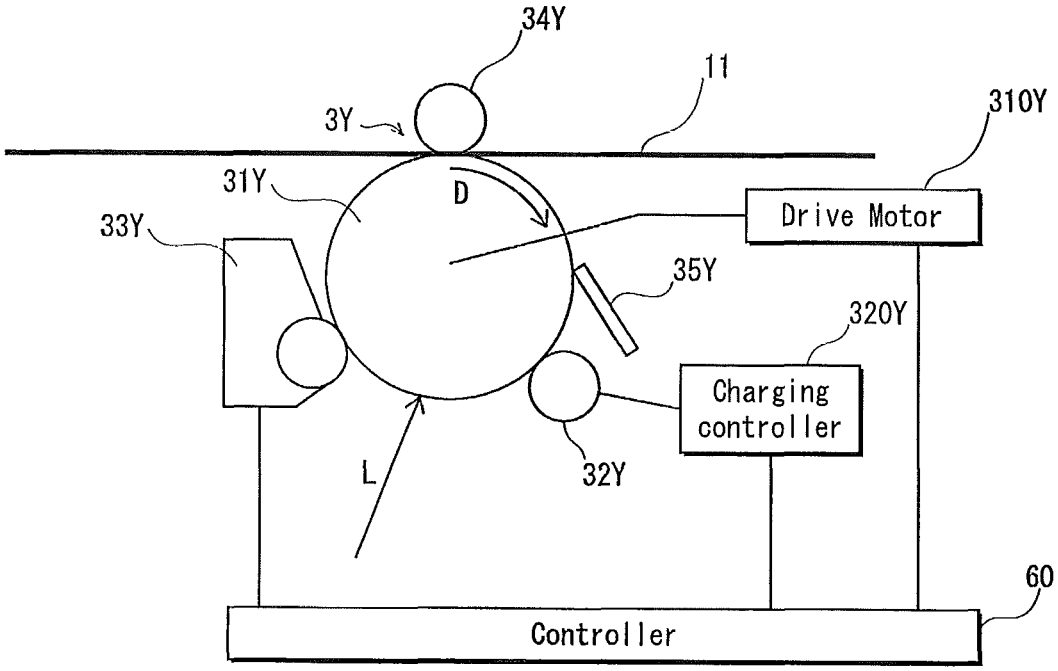
FIG. 2 is a schematic diagram illustrating configuration of an image creation sub-unit 3Y.

The image processing unit 3 includes image creation sub-units 3Y, 3M, 3C and 3K, a light exposure sub-unit 10, an intermediate transfer belt 11, and a secondary transfer roller 45. The image processing unit 3 also includes an internal temperature sensor 36 and an internal humidity sensor 37, which are located in proximity to a photosensitive drum of the image creation sub-unit 3K. Note that the internal temperature sensor 36 and internal humidity sensor 37 are explained further below. The image creation sub-units 3Y, 3M, 3C, and 3K each have the same configuration. Therefore, the following explanation focuses mainly on the image creation sub-unit 3Y. FIG. 2 is a schematic diagram illustrating configuration of the image creation sub-unit 3Y.

The image creation sub-unit 3Y includes a photosensitive drum 31Y which is caused to rotate in a direction indicated by arrow D by a drive motor 310Y. The image creation sub-unit 3Y also includes a charger 32Y, a developer 33Y, a primary transfer roller 34Y, and a cleaning blade 35Y, which are located in respective order around the photosensitive drum 31Y in terms of rotation direction D. The charger 32Y is driven by a charging controller 320Y. The cleaning blade 35Y is applied against an image carrier surface of the photosensitive drum 31Y and cleans the image carrier surface, after primary transfer of a toner image onto the intermediate transfer belt 11, by removing toner remaining on the image carrier surface after the primary transfer. Note that in FIG. 2, reference sign 11 indicates the intermediate transfer belt and arrow L indicates laser light emitted from the light exposure sub-unit 10.

During an image formation operation, in the image creation sub-unit 3Y, the photosensitive drum 31Y is rotationally driven in the direction indicated by arrow D under control of the controller 60 such that process steps of charging, light exposure scanning, developing, transfer, and cleaning are repeated in order on the image carrier surface of the photosensitive drum 31Y. Consequently, toner images based on respective image data of each page are sequentially formed on the image carrier surface and subsequently transferred onto the intermediate transfer belt 11. During the image formation operation, residual charge is removed from the photosensitive drum 31Y by the charger 32Y applying an electrical charge to the image carrier surface during a period between completion of light exposure scanning based on image data of a preceding page and commencement of light exposure scanning based on image data of a next page after the preceding page. The aforementioned period corresponds to an interval between successive recording sheets and is referred to below as an inter-sheet period. The following provides more specific explanation of performance of the process outlined above.

The drive motor 310Y rotationally drives the photosensitive drum 31Y in the direction indicated by arrow D and the charging controller 320Y drives the charger 32Y such that electrical charge is applied evenly across the image carrier surface of the photosensitive drum 31Y (note that a predetermined charging potential is applied such as 800 V). Next, when timing for light exposure scanning is reached, light exposure scanning by laser light L of the photosensitive drum 31Y, which has been charged, commences based on image data of a single page, and through the light exposure scanning, an electrostatic latent image for the single page is formed on the image carrier surface.

Rotational drive of the photosensitive drum 31Y causes the image carrier surface, on which the electrostatic latent image is formed, to circulate to a position opposite the developer 33Y. The developer 33Y develops the electrostatic latent image, thereby forming a toner image on the image carrier surface. Next, the primary transfer roller 34Y causes transfer of the toner image onto an image carrier surface of the intermediate transfer belt 11. The cleaning blade 35Y removes residual toner remaining on the image carrier surface of the photosensitive drum 31Y after transfer of the toner image onto the intermediate transfer belt 11.

Also, once the aforementioned light exposure scanning is complete, the charger 32Y removes residual charge from the photosensitive drum 31Y during the inter-sheet period through charging of the image carrier surface of the photosensitive drum 31Y, while the photosensitive drum 31Y is rotating in the direction indicated by arrow D. Note that during the inter-sheet period, process steps such as light exposure scanning, developing, and transfer are not performed. The image creation sub-units 3M, 3C, and 3K each perform the same process as described above for the image creation sub-unit 3Y.

Returning to explanation of FIG. 1, respective toner images formed through the aforementioned process in the image creation sub-units 3Y, 3M, 3C, and 3K are each transferred onto the image carrier surface of the intermediate transfer belt 11 by the primary transfer roller of the corresponding image creation sub-unit (note that in FIG. 1 only the primary transfer roller corresponding to the image creation sub-unit 3Y is labeled by reference sign 34*y*, whereas reference signs are omitted for the other primary transfer rollers). Timing of primary transfer of the aforementioned toner images is staggered such that the toner images are each formed at the same position on the image carrier surface of the intermediate transfer belt 11, superimposed on one another. Subsequently, electrostatic force from a secondary transfer roller 45 causes secondary transfer at a secondary transfer position 46 of the toner images formed on the image carrier surface of the intermediate transfer belt 11, such that the toner images are collectively transferred onto a recording sheet.

Figure 3:
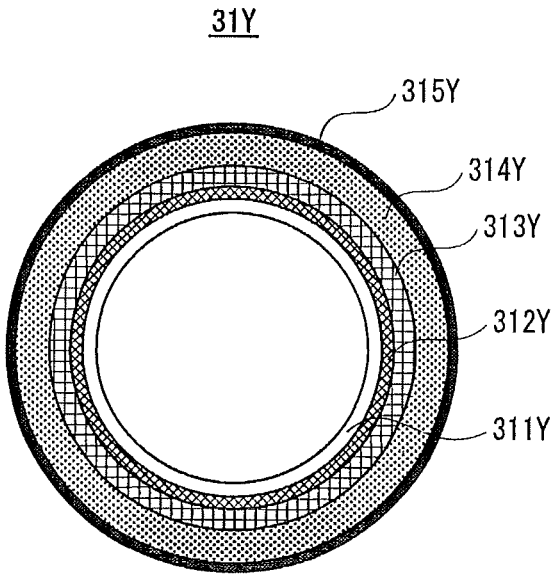
FIG. 3 is a cross-sectional diagram illustrating layer configuration of a photosensitive drum 31Y.
Figure 16:
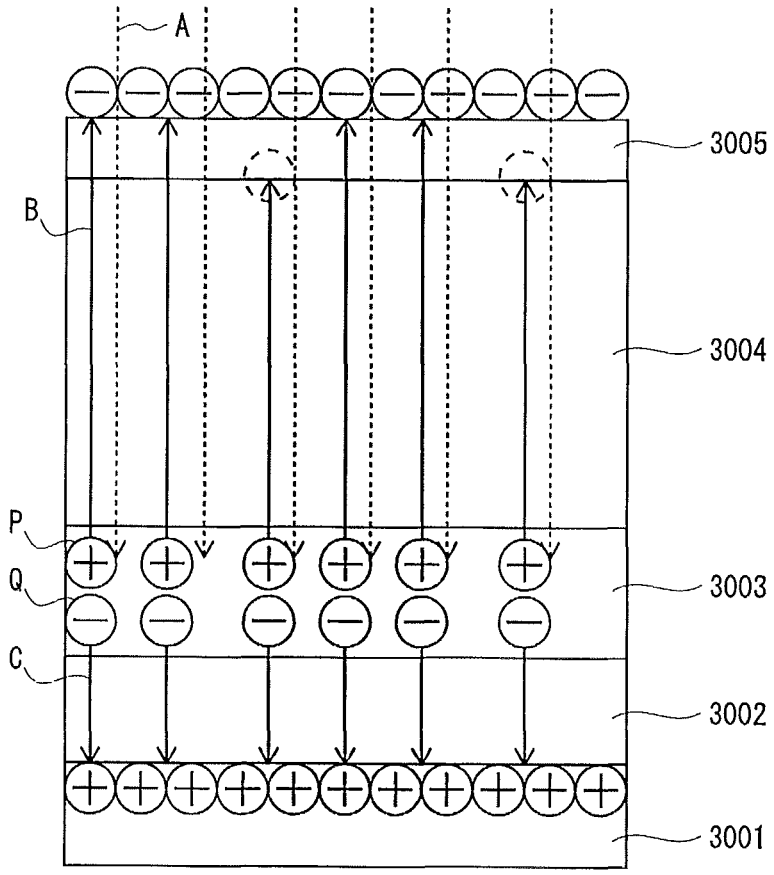
FIG. 16 Prior Art
FIG. 16 is a cross-sectional diagram illustrating one example of layer configuration of a conventional photosensitive body.

FIG. 3 is a cross-sectional diagram illustrating layer configuration of the photosensitive drum 31Y. In the same way as the configuration illustrated in FIG. 16, the photosensitive drum 31Y includes a conductive substrate 311Y, and, layered in respective order there on, a UCL 312Y, a CGL 313Y, a CTL 314Y, and a protective layer 315Y.

The conductive substrate 311Y is made of a conductive material. Examples of conductive materials that can be used to make the conductive substrate 311Y include metals such as aluminum, copper, chromium, nickel, zinc and stainless steel, plastic film having a metal foil such as of aluminum or copper laminated thereon, plastic film having aluminum, indium oxide, tin oxide or the like vapor deposited thereon, and metal, plastic film, or paper for which a conductive substance forms a conductive layer either by itself or in combination with a binder resin.

The UCL 312Y is for example made of a resin. Examples of resins that can be used to make the UCL 312Y include water soluble resins such as polyvinyl alcohol, casein and sodium polyacrylate, alcohol soluble resins such as copolymer nylon, methoxymethylated nylon, and hardening resins that form a three dimensional mesh structure such as polyurethane, melamine resins, alkyd melamine resins, and epoxy resins. Note that alternatively the aforementioned resin may include a fine powder of a metal oxide, such as titanium oxide, silica, zirconium oxide, tin oxide or indium oxide, a metal sulfide, or a metal nitride.

The CGL 313Y is for example made of a charge generating material and a resin. Examples of charge generating materials that can be used to make the CGL 313Y include azo pigments such as Sudan red and cyan blue, quinone pigments such as bilene quinone and anthroanthrone, quinocyanine pigments, perylene pigments, indigo pigments such as indigo and thioindigo, and phthalocyanine pigments.

Examples of resins that can be used to make the CGL 313Y include polystyrene resins, polyethylene resins, polypropylene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, or copolymer resins of any two or more of the aforementioned resins (for example, a copolymer resin of vinyl chloride and vinyl acetate).

The CTL 314Y is for example made of a hole transport material and a resin. Examples of charge transport materials that can be used to make the CTL 314Y include mixtures of two or more out of carbazole derivatives, oxazole derivatives, oxadiazole derivatives, thiazole derivatives, thiadiazole derivatives, triazole derivatives, imidazole derivatives, imidazolone derivatives, imidazolidine derivatives, bis-imidazolidine derivatives, styryl compounds, hydrazone compounds, pyrazoline compounds, oxazolone derivatives, benzimidazole derivatives, quinazoline derivatives, benzofuran derivatives, acridine derivatives, fenadine derivatives, aminostilbene derivatives, triarylamine derivatives, phenylenediamine derivatives, stilbene derivatives, benzidine derivatives, poly-N-vinylcarbazole, poly-1-vinylpyrene and poly-9-vinylanthracene, and triphenylamine derivatives, Examples of resins that can be used to make the CTL 314Y include polycarbonate resins, polyacrylate resins, polyester resins, polystyrene resins, styrene-acrylonitrile copolymer resins, polymethacrylic ester resins, and styrene-methacrylic ester copolymer resins.

The protective layer 315Y is for example made of a binder resin and inorganic fine particles. The binder resin may for example be a thermoplastic resin or a thermosetting resin. Examples of resins that can be used to make the protective layer 315Y include polyvinyl butyral resins, epoxy resins, polyurethane resins, phenol resins, polyester resins, alkyd resins, polycarbonate resins, silicone resins, and melamine resins.

Example of inorganic fine particles that can be used to make the protective layer 315Y include silica, alumina, strontium titanate, zinc oxide, titanium oxide, tin oxide, antimony oxide, indium oxide, bismuth oxide, and zirconium oxide. Note that respective photosensitive drums in the image creation sub-units 3M, 3C, and 3K each have the same configuration as the photosensitive drum 31Y.

Returning to explanation of FIG. 1, the light exposure sub-unit 10 includes a light-emitting element such as a laser diode. A drive signal from the controller 60 causes the light exposure sub-unit 10 to emit laser light L for forming images of the Y, M, C, and K colors. The light exposure sub-unit 10 uses the laser light L to perform light exposure scanning on the image carrier surface of the photosensitive drum in each of the image creation sub-units 3Y, 3M, 3C, and 3K, while the photosensitive drum rotates in a direction indicated by an arrow in FIG. 1. The light exposure scanning causes an electrostatic latent image to form on the image carrier surface of the photosensitive drum 31Y, to which an electrical charge has been applied by the charger 32Y. Note that an electrostatic latent image is formed in the same way on the image carrier surface of the photosensitive drum in each of the image creation sub-units 3M, 3C, and 3K.

The intermediate transfer belt 11 is a continuous belt which is stretched across a driving roller 12 and a driven roller 13. The intermediate transfer belt 11 circulates in a direction indicated by arrow C. A cleaner 21 located in proximity to the driven roller 13 removes residual toner from the image carrier surface of the intermediate transfer belt 11.

The sheet feeder 4 includes a sheet feeder cassette 41, a pick-up roller 42, and a timing roller 44. The sheet feeder cassette 41 stores therein recording sheets indicated by reference sign S in FIG. 1. The pick-up roller 42 picks up recording sheets stored in the sheet feeder cassette 41, one at a time, and conveys each of the recording sheets along a conveyance path 43. The timing roller 44 controls timing at which a recording sheet is conveyed to the secondary transfer position 46 after having been picked-up from the sheet feeder cassette 41. Note that the number of sheet feeder cassettes 41 is not limited to one and alternatively a plurality of sheet feeder cassettes 41 may be included in the sheet feeder 4.

Sheets of various different sizes and thicknesses (for example, paper and card), and also film sheets such as overhead projector (OHP) sheets can be used as the recording sheets. In a configuration in which a plurality of sheet feeder cassettes 41 are included, each of the sheet feeder cassettes 41 may be used to store recording sheets of a different size or of a different type of material.

A conveyance motor (not illustrated) functions as a source of driving force for rollers such as the pick-up roller 42 and the timing roller 44. The conveyance motor rotationally drives the aforementioned rollers through a drive transmission mechanism (not illustrated) configured by a belt, gears or the like. The conveyance motor may for example be a stepping motor which enables high precision control of rotational speed.

A recording sheet is conveyed from the sheet feeder 4 to the secondary transfer position 46 in accordance with timing at which toner images on the image carrier surface of the intermediate transfer belt 11 move to the secondary transfer position 46. The secondary transfer roller 45 causes secondary transfer of the toner images on the image carrier surface of the intermediate transfer belt 11, such that the toner images are collectively transferred onto the recording sheet as a single toner image. After secondary transfer of the single toner image onto the recording sheet, the recording sheet is conveyed to the fixing device 5. The fixing device 5 thermally fixes the toner image (unfixed image) to the recording sheet through application of heat and pressure. After fixing by the fixing device 5, an ejection roller 71 ejects the recording sheet onto an ejection tray 72.

2. Controller Configuration

Figure 4:
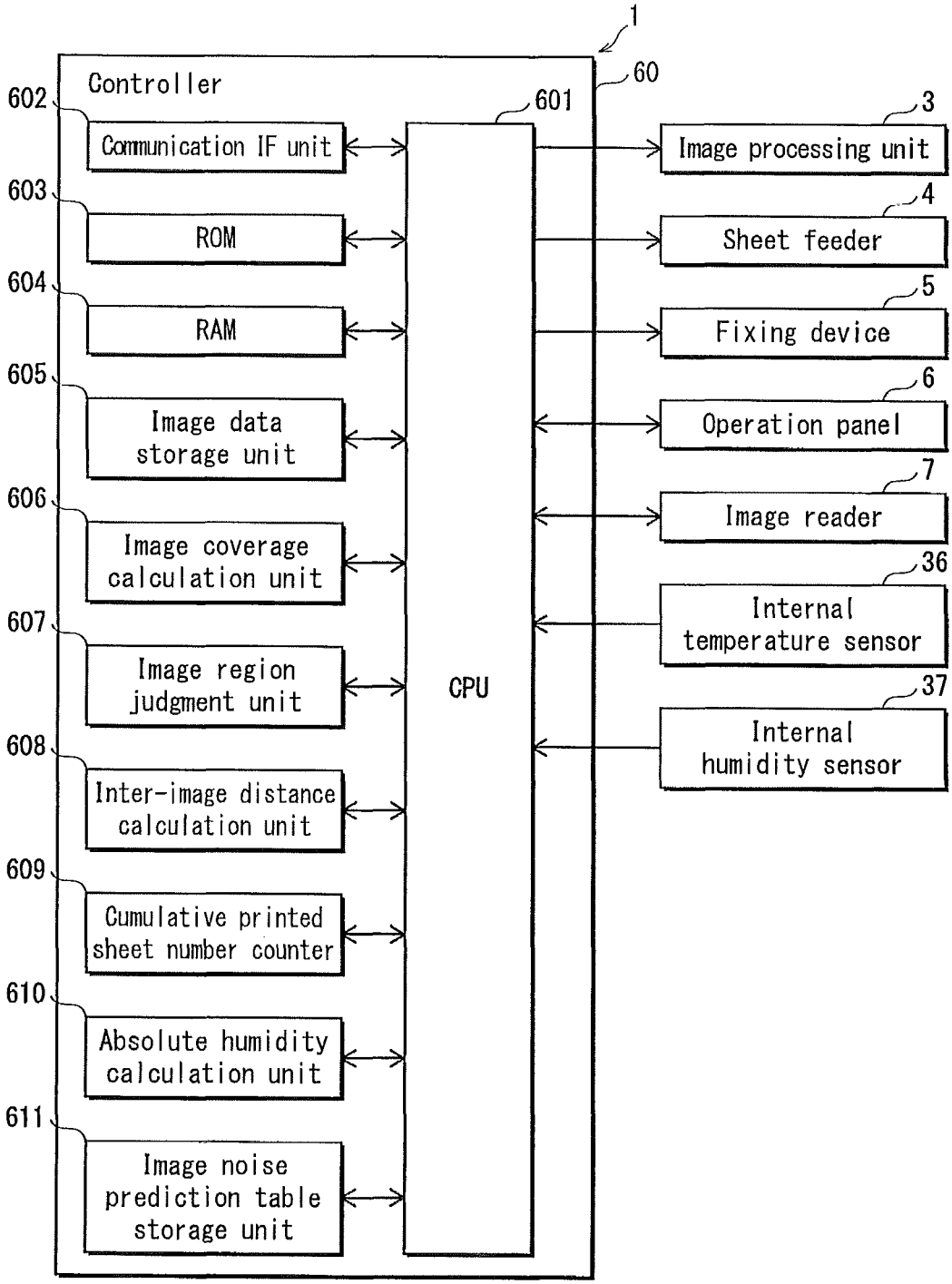
FIG. 4 illustrates configuration of a controller 60 and relationship to main configuration elements which are control targets of the controller 60.

FIG. 4 illustrates configuration of the controller 60 and relationship of main configuration elements which are control targets of the controller 60. The controller 60 is a so called computer and, as illustrated in FIG. 4, the controller 60 includes a central processing unit (CPU) 601, a communication interface (I/F) unit 602, read only memory (ROM) 603, random access memory (RAM) 604, an image data storage unit 605, an image coverage calculation unit 606, an image region judgment unit 607, an inter-image distance calculation unit 608, a cumulative printed sheet number counter 609, an absolute humidity calculation unit 610, and an image noise prediction table storage unit 611.

The communication I/F unit 602 is an interface to a LAN such as a LAN card or LAN board. The ROM 603 stores a program therein for controlling each of the image processing unit 3, the sheet feeder 4, the fixing device 5, an operation panel 6, an image reader 7, the internal temperature sensor 36, and the internal humidity sensor 37, and also an image formation processing program for performing image formation processing which is explained further below. The RAM 604 is used as a work area during execution of programs by the CPU 601. The image data storage unit 605 stores therein printing image data (bitmap data).

The image coverage calculation unit 606 calculates a coverage value of each page for each of the Y, M, C, and K colors. Herein, the term coverage refers to a percentage value indicating, for a corresponding page and color, surface area of a toner deposition region as a proportion of surface area of an image formation region within which the toner deposition region is included. The term toner deposition region refers to a region in which toner of the corresponding color is deposited when a toner image of the color is formed on the image carrier surface of the photosensitive drum. The term image formation region refers to a region in which an image of a single page can be formed.

The image coverage calculation unit 606 calculates coverage of each page for each of the Y, M, C, and K colors as explained below. For each page, the image coverage calculation unit 606 counts a number of pixels in printing image data for which toner of each of the Y, M, C, and K colors is to be applied. Herein, the aforementioned pixels are referred to as toner deposition pixels. Thus, the image coverage calculation unit 606 counts a total pixel number of toner deposition pixels for each of the Y, M, C, and K colors. The image coverage calculation unit 606 calculates coverage of the corresponding page for each of the colors by converting the total pixel number of toner deposition pixels which is counted for the color to a proportion (percentage) of a total pixel number for the image formation region of a single page. Note that the total pixel number for the image formation region of a single page is stored in advance for each different sheet size (for example, in the ROM 603).

The image region judgment unit 607 performs a judgment for each page as to whether an image indicated by image data of the page is a text image. The judgment as to whether or not the image data indicates a text image can be performed using any of various common knowledge techniques. For example, the judgment can be performed by acquiring a distribution of total pixel number in a main scanning direction and a sub-scanning direction for pixels in printing image data of a single page stored in the image data storage unit 605, and by detecting periodicity in the distribution.

In the case of a text image, total pixel number is 0 in intervals between rows and columns in which text is arranged and periodicity occurs due to sections for which total pixel number is 0 repeating at fixed intervals in the text image. The judgment described above can be performed through detection of such periodicity (refer to paragraphs 0058-0060, and FIGS. 6 and 7 of Japanese Patent Application Publication No. 2007-259466). The image of the page is judged to be a text image when periodicity is detected throughout image data of the page, or when the image data includes a section in which periodicity is detected and a blank section. When periodicity is only detected in a section of the image (i.e., when judging that the image includes a text image section and a non-text image section), the image is judged to not be a text image.

Alternatively, the judgment as to whether the image of the page is a text image can be performed using edge detection processing as described below. Edge detection processing is performed by, in turn, setting each pixel in image data of a single page as a focus pixel, extracting pixels in proximity to the focus pixel, and performing filter processing on the extracted pixels using an edge detection filter. Through the above, edge pixels which form contours of the image can be detected. Next, if an edge pixel is detected through edge detection processing, the focus pixel is judged to be an edge pixel and difference values between respective pixel values (gradation values) of the focus pixel and the pixels in proximity thereto are calculated. When at least a fixed number of the difference values are greater than a predetermined threshold value, the focus pixel is judged to be an edge pixel configuring a text image. When a number of edge pixels which are judged to be configuring a text image is at least equal to a threshold value, the image of the page is judged to be a text image, and when the number of edge pixels which are judged to be configuring a text image is lower than the threshold value, the image of the page is judged to not be a text image (refer to paragraph 0065 of Japanese Patent Application Publication No. 2013-74495).

Alternatively, when image data in page description language (PDL) is acquired from the terminal, judgment as to whether an image indicated by image data is a text image can be performed for each page by analyzing the PDL and judging whether commands related to text are included in the PDL (for example, a command indicating a text size or a command setting a font).

For each of the Y, M, C, and K colors, the inter-image distance calculation unit 608 acquires a distribution (herein, referred to as a pixel distribution) in the sub-scanning direction of a total pixel number of toner deposition pixels in the main scanning direction for printing image data of a single page. The aforementioned distribution corresponds to a distribution in the sub-scanning direction of a toner image of the page when the toner image is expanded in the sub-scanning direction during formation on the image carrier surface of the photosensitive drum. The inter-image distance calculation unit 608 calculates a distance (herein, referred to as an inter-image distance) between a trailing end of a region in which toner deposition pixels are distributed (i.e., a region in which total pixel number is not zero) in the pixel distribution of the page, and a leading end of a region in which toner deposition pixels are distributed in a pixel distribution of a next page after the aforementioned page. The inter-image distance which is calculated corresponds to, and thus acts as an indicator for, a distance between a trailing end of a distribution region in the sub-scanning direction for a toner image of a preceding page, when the toner image of the preceding page is expanded in the sub-scanning direction, and a leading end of a distribution region in the sub-scanning direction for a toner image of a next page after the preceding page, when the toner image of the next page is expanded in the sub-scanning direction. The following provides further explanation of the inter-image distance through a specific example.

Figure 5:
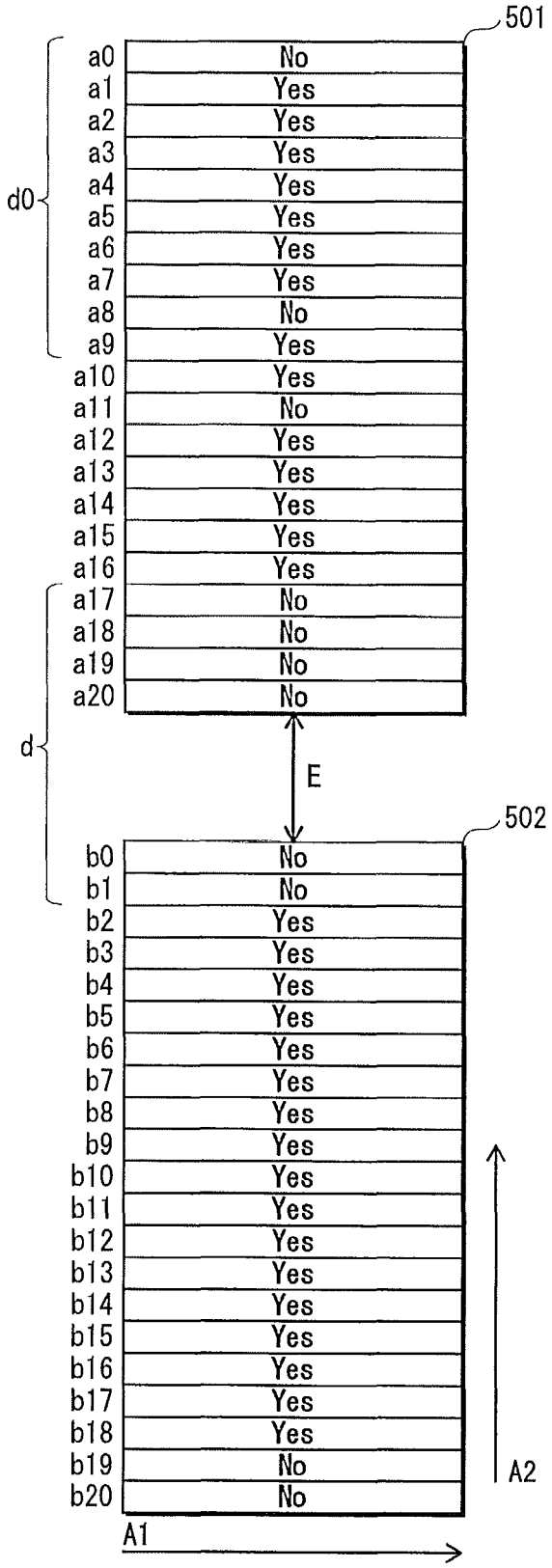
FIG. 5 is a schematic diagram illustrating, in terms of a yellow color, relationship between pixel distribution of printing image data of a preceding page, pixel distribution of printing image data of a next page, and inter-image distance.

FIG. 5 is a schematic diagram illustrating, for the Y color, relationship between a pixel distribution of printing image data of a preceding page, a pixel distribution of printing image data of a next page, and inter-image distance. In FIG. 5, arrow A1 indicates the main scanning direction and arrow A2 indicates the sub-scanning direction. Reference sign 501 indicates a pixel distribution in the sub-scanning direction of image data of the preceding page and reference sign 502 indicates a pixel distribution in the sub-scanning direction of image data of the next page. The aforementioned pixel distributions are each acquired through the inter-image distance calculation unit 608 calculating a total pixel number of toner deposition pixels for each of a plurality of sections (herein, referred to as preset pixel sections), which are each a preset number of pixels (one or more) in width.

Reference signs a0-a20 and b0-b20 each indicate one of the aforementioned preset pixel sections. Note that in the present example, reference sign d0 indicates a group of 10 preset pixel sections which are equivalent, in terms of length, to circumferential length of the photosensitive drum. In each of the preset pixel sections, "Yes" indicates that a total pixel number of toner deposition pixels in the main scanning direction is not zero for image data of the preset pixel section, whereas "No" indicates that the total pixel number of toner deposition pixels for the preset pixel section is zero.

Arrow E in FIG. 5 indicates inter-sheet distance. Note that in the example illustrated in FIG. 5, the inter-sheet distance is for a situation in which length of an inter-sheet period is set as a default time. The term inter-sheet distance refers to a distance rotated by the circumference of the photosensitive drum 31Y during the inter-sheet period. Herein, when length of the inter-sheet period is set as the default time, the inter-sheet distance is referred to as a default inter-sheet distance. The default inter-sheet distance can be calculated through multiplication of the default time and rotational speed of the circumference of the photosensitive drum, and is stored in advance, for example in the ROM 603.

Note that the term default time refers to a time set as length of the inter-sheet period in a situation in which image noise caused by residual charge in the photosensitive drum is not predicted to occur during image formation processing, which is explained further below. Extension of the inter-sheet distance causes reduction in image formation productivity. Therefore, the default time is set in advance by a manufacturer of the printer 1 such that the default inter-sheet distance is shorter than circumferential length of the photosensitive drum (for example, such that the default inter-sheet distance is equivalent to the circumferential length multiplied by a factor of 0.8).

In the example illustrated in FIG. 5, the inter-image distance calculation unit 608 acquires the pixel distribution of the preceding page 501, and calculates a pixel width between a trailing end of the preceding page 501 and a trailing end of a region in which toner deposition pixels are distributed in terms of the preset pixel sections distributed in the sub-scanning direction (i.e., a trailing end of preset pixel section a16, which is a closest preset pixel section, relative to the trailing end of the preceding page 501, in which at least one toner deposition pixel is present). Note that in the example illustrated in FIG. 5, the aforementioned pixel width is equivalent to four preset pixel sections a17-a20. The inter-image distance calculation unit 608 calculates a value H1 by converting the aforementioned pixel width into units of length (mm) based on a resolution set when commencing the image formation operation.

Next, the inter-image distance calculation unit 608 acquires the pixel distribution of the next page 502, which is a page directly after the preceding page 501, and calculates a pixel width between a leading end of the next page 502 and a leading end of a region in which toner deposition pixels are distributed in terms of the preset pixel sections distributed in the sub-scanning direction (i.e., a leading end of preset pixel section b2, which is a closest preset pixel section, relative to the leading end of the next page 502, in which at least one toner deposition pixel is present). Note that in the example illustrated in FIG. 5, the aforementioned pixel width is equivalent to two preset pixel sections b0 and b1. The inter-image distance calculation unit 608 calculates a value H2 by converting the aforementioned pixel width into units of length (mm) based on the resolution set when commencing the image formation operation.

The inter-image distance calculation unit 608 subsequently calculates inter-image distance d as shown below in MATH. 1, using the values H1 and H2 which are calculated, and inter-sheet distance E (note that in the present example the inter-sheet distance is the default inter-sheet distance).

$$d=H1+H2+E \quad \text{(MATH. 1)}$$

The inter-image distance calculation unit 608 calculates an inter-image distance for each of the M, C, and K colors in the same way as described for the Y color.

Returning to explanation of FIG. 4, the cumulative printed sheet number counter 609 increases a count value by one each time a recording sheet is ejected onto the ejection tray 72. Through the above, the cumulative printed sheet number counter 609 counts a cumulative number of printed sheets, which acts as an indicator of an amount of usage of the photosensitive drum for each of the colors. The aforementioned count value is set to zero by the cumulative printed sheet number counter 609 prior to shipping of the printer 1 and subsequently the count value is reset to zero each time the photosensitive drums are replaced. Replacement of the photosensitive drums can for example be detected by a sensor (not illustrated). In the present example, ejection of a recording sheet is detected by a sheet sensor (not illustrated) which detects when the recording sheet passes in proximity to the ejection roller 71 illustrated in FIG. 1.

Note that a method of acquiring an indicator of usage amount of the photosensitive drum for each of the colors is not limited to the method described above in which a cumulative number of printed sheets is counted. For example, alternatively an indicator of usage amount of the photosensitive drum for each of the colors may be obtained by counting an operation time of a drive motor which drives the photosensitive drum.

The absolute humidity calculation unit 610 acquires an internal temperature and an internal relative humidity within the printer 1 through the internal temperature sensor 36 and the internal humidity sensor 37 respectively. The absolute humidity calculation unit 610 calculates an absolute humidity ($g/m^3$) using the internal temperature and the internal relative humidity which are acquired, and using an absolute humidity calculation table indicating a relationship of absolute humidity relative to internal temperature and internal relative humidity. The absolute humidity calculation table is created and stored in advance by the manufacturer of the printer 1 (for example, the absolute humidity calculation table can be stored in the ROM 603).

The image noise prediction table storage unit 611 stores an image noise prediction table therein. The image noise prediction table can for example be a table indicating relationship between coverage ranges, absolute humidity ranges, and number of printed sheets necessary before image noise is predicted to occur due to accumulation of residual charge in the photosensitive drum (herein, the aforementioned number of printed sheets is referred to as a image noise threshold value). The type of image noise prediction table described above is referred to below as a coverage-humidity prediction table. Alternatively, the image noise prediction table can be a table which only indicates relationship between coverage ranges and image noise threshold values, which is referred to below as a default prediction table.

Note that alternatively a different image noise prediction table may be stored for each different sheet size of recording sheets used in the printer 1. Also, the relationships described above change in accordance with cumulative number of printed sheets (i.e., amount of usage of the photosensitive drum) as explained further below. Consequently, a plurality of image noise prediction tables may be stored which each correspond to a certain range in terms of cumulative number of printed sheets. Note that the image noise prediction table storage unit 611 may store a lower limit of noise non-occurrence.

The term lower limit of noise non-occurrence refers to a cumulative number of printed sheets corresponding to a lower limit in terms of usage amount of the photosensitive drum at which image noise does not occur due to accumulation of residual charge in the photosensitive drum, regardless of coverage and absolute humidity. Note that a different lower limit of noise non-occurrence may be set for each sheet size.

The inventor of the present application conducted experiments in order to investigate the aforementioned relationships using the printer 1 relating to the present embodiment. Specifically, during the experiments, toner images for which the K color had one of a plurality of predetermined coverages (coverages of 20%, 40%, 60%, 80%, and 100%) were printed successively for 20 sheets using A3 recording sheets at each of a plurality of different absolute humidities (absolute humidities of 3 $g/m^3$, 6 $g/m^3$, 9 $g/m^3$, 12 $g/m^3$, and 14 $g/m^3$). Through the above experiments, a number of printed sheets necessary before image noise occurred due to accumulation of residual charge in the photosensitive drum for the K color was investigated. In the experiments described above, the photosensitive drum for the K color had a circumferential length of 188 mm and length of an inter-sheet period was set such that inter-sheet distance was 150 mm.

In terms of usage amount of the photosensitive drum for each of the colors used in the printer 1, three different types were used for which the cumulative numbers of printed sheets were respectively 0, 3000, and 5000. Thus, the experiments described above were performed for the printer 1 using photosensitive drums for each of the colors having three different usage amounts corresponding to the cumulative numbers of printed sheets described above.

FIGS. 6A-6C illustrate results of the aforementioned experiments. FIG. 6A illustrates results when cumulative number of printed sheets was zero for the photosensitive drum for each of the colors in the printer 1. FIG. 6B illustrates results when cumulative number of printed sheets was 3000 for the photosensitive drum for each of the colors in the printer 1. FIG. 6C illustrates results when cumulative number of printed sheets was 5000 for the photosensitive drum for each of the colors in the printer 1. In FIGS. 6A-6C, "No" indicates that image noise did not occur for the corresponding coverage and absolute humidity, whereas a number enclosed in a circle indicates a number of printed sheets that were necessary for image noise to occur.

The results in FIGS. 6A-6C indicate that image noise occurred less frequently when usage amount (i.e., cumulative number of printed sheets) of the photosensitive drum was higher, and that occurrence of image noise was not observed at all when the usage amount of the photosensitive drum corresponded to a cumulative number of printed sheets of 5000.

With respect to relationship between coverage and occurrence of image noise, the experiment results in FIGS. 6A and 6B indicate that image noise tended to occur more readily when coverage was high. For example, FIG. 6A indicates that in a situation in which usage amount of the photosensitive drum was zero, image noise occurred when coverage was 40% or greater, and also indicates that for coverage of 40% or greater, the number of printed sheets necessary for image noise to occur tended to be lower for higher coverage. Likewise, FIG. 6B indicates that in a situation in which usage amount of the photosensitive drum corresponded to the cumulative number of printed sheets of 3000, image noise occurred when coverage was 60% or greater, and also indicates that for coverage of 60% or greater, the number of printed sheets necessary for image noise to occur tended to be lower for higher coverage. The trend described above of image noise occurring more readily when coverage is high is thought to arise due to the photosensitive drum being exposed to a greater amount of light when coverage is high. As a consequence of greater light exposure, a greater number of holes are generated in the CGL of the photosensitive drum, increasing probability of holes becoming trapped at the interface between the CTL and the protective layer.

With respect to relationship between absolute humidity and occurrence of image noise, experiment results in FIGS. 6A and 6B indicate that image noise tended to occur more readily when absolute humidity was low. More specifically, FIG. 6A indicates that in a situation in which usage amount of the photosensitive drum was zero, when absolute humidity was low, image noise tended to occur even for low coverage. For example, at a low absolute humidity of 3 $g/m^3$, image noise occurred for coverage of 40% or greater, whereas at a high absolute humidity of 14 $g/m^3$, image noise only occurred for coverage of 100% and did not occur for coverage of 80% or less.

Likewise, in a situation in which usage amount of the photosensitive drum corresponded to the cumulative number of printed sheets of 3000, when absolute humidity was low, image noise tended to occur even for low coverage. For example, at a low absolute humidity of 3 $g/m^3$, image noise occurred for coverage of 60% or greater, whereas at an absolute humidity of 6 $g/m^3$, image noise occurred for coverage of 80% or greater, and at a high absolute humidity of 9 $g/m^3$ or greater, image noise did not occur.

The trend described above of image noise occurring less readily when absolute humidity is high is thought to be due to moisture scattered on the protective layer causing increased conductivity thereof. As a consequence of the above, holes trapped at the interface between the CTL and the protective layer are able to move more easily through the protective layer to the surface of the photosensitive drum.

As described above, frequency of image noise occurrence varies in accordance with usage amount of a photosensitive drum, coverage of an image of a page to be printed, and internal absolute humidity. Consequently, the inventor of the present application conducted experiments in the same way as described above for each different size of recording sheet and created image noise prediction tables based on results of the experiments. The inventor used the image noise prediction tables in order to predict whether or not image noise occurs during an image formation operation due to accumulation of residual charge in a photosensitive drum.

FIGS. 7A and 7B illustrate specific examples of the image noise prediction tables described above. The image noise prediction tables in FIGS. 7A and 7B are each based on the experiment results illustrated in FIGS. 6A-6C. More specifically, FIG. 7A illustrates a specific example of an image noise prediction table for use when sheet size of a recording sheet is A3 and usage amount of a photosensitive drum for each of the colors corresponds to a cumulative number of printed sheets in a range from 0 to 2999. The image noise prediction table in FIG. 7A is based on experiment results illustrated in FIG. 6A.

FIG. 7B illustrates a specific example of an image noise prediction table for use when sheet size of a recording sheet is A3 and usage amount of a photosensitive drum for each of the colors corresponds to a cumulative number of printed sheets in a range from 3000 to 4999. The image noise prediction table in FIG. 7B is based on experiment results illustrated in FIG. 6B. Note that image noise does not occur when usage amount of the photosensitive drum for each of the colors corresponds to a cumulative number of printed sheets which is 5000 or greater. Therefore, an image noise prediction table is not created for when the cumulative number of printed sheets is 5000 or greater. Based on the experiment results, a lower limit for noise non-occurrence is set as 5000 sheets in the case of recording sheets of A3 sheet size. In FIGS. 7A and 7B, reference sign "P" indicates coverage and reference sign "N" indicates absolute humidity. Note that in FIGS. 7A and 7B, "No" indicates that image noise does not occur when coverage and absolute humidity are in ranges corresponding thereto (i.e., there is no image noise threshold value in such a situation). On the other hand, a number enclosed within a circle indicates an image noise threshold value when coverage and absolute humidity are in ranges corresponding thereto. Note that in the image noise prediction table, a coverage range having one or more image noise threshold values corresponding thereto is referred to as a noise occurrence coverage range.

For example, in the image noise prediction table in FIG. 7A, coverage ranges indicated by "$40 \leq P < 60$", "$60 \leq P < 80$", "$80 \leq P < 100$", and "$P = 100$" are each a noise occurrence coverage range. In the image noise prediction table in FIG. 7B, coverage ranges indicated by "$60 \leq P < 80$", "$80 \leq P < 100$", and "$P = 100$" are each a noise occurrence coverage range.

Note that in the present example, a default prediction table is used as the image noise prediction table. For example, the default prediction table may indicate relationship between image noise threshold value and coverage range for an absolute humidity range in which image noise occurs most frequently, which in the case of the image noise prediction table in FIG. 7A is when absolute humidity N is in a range "$N \leq 3$".

Returning to explanation of FIG. 4, the operation panel 6 for example includes a liquid crystal display and a touch panel layered thereon, or operation buttons for input of various commands. The operation panel 6 receives input of various commands from a user through operations performed on the touch panel or the operation buttons. The image reader 7 is an image input device such as a scanner, which generates image data by reading information such as text, a diagram, or a photograph on a sheet such as a recording sheet.

The internal temperature sensor 36 measures temperature within the printer 1 and outputs measurement results to the controller 60. The internal humidity sensor 37 measures relative humidity within the printer 1 and outputs measurement results to the controller 60.

3. Image Formation Processing

Figure 8:
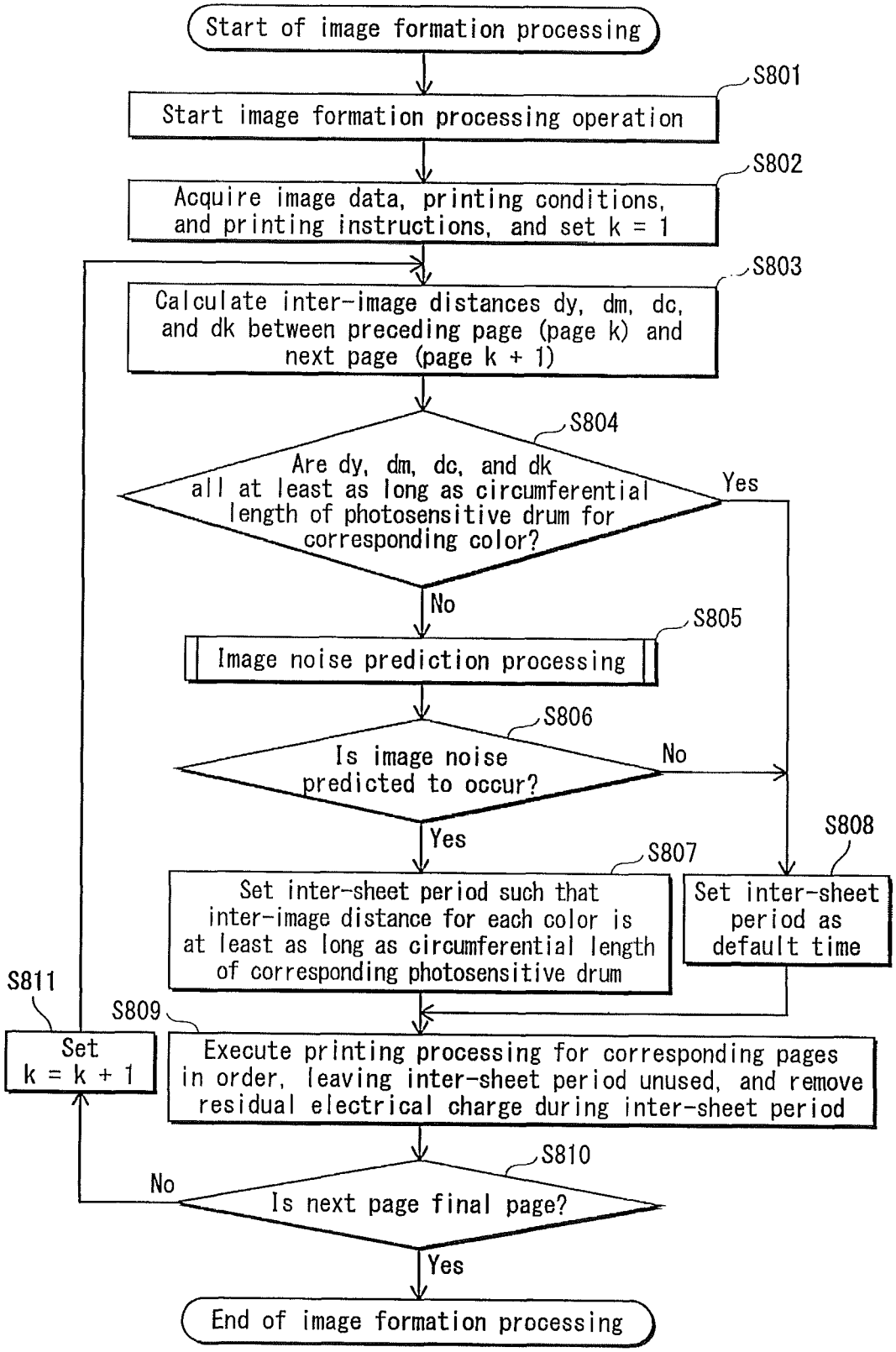
FIG. 8 is a flowchart illustrating image formation processing.

The following explains image formation processing performed by the controller 60. FIG. 8 is a flowchart illustrating operation during the image formation processing. The controller 60 starts operation during the image formation processing through start-up of an image formation processing program stored in the ROM 603 (Step S801). Upon the controller 60 acquiring image data, printing conditions, and printing instructions through the communication I/F unit 602, or through the operation panel 6 and the image reader 7, the controller 60 generates printing image data (bitmap data) from the acquired image data, stores the printing image data in the image data storage unit 605, and initializes variable k, indicating a page number, as a value of 1 (Step S802).

Next, for each of the Y, M, C and K colors, the controller 60 acquires image data from the image data storage unit 605 for a preceding page (page k) and a next page (page k+1) after the preceding page, and calculates inter-image distances dy, dm, dc and dk between the preceding page and the next page (Step S803). Note that dy, dm, dc, and dk indicate inter-image distances for the Y, M, C and K colors respectively. The controller 60 judges whether the inter-image distances dy, dm, dc, and dk are all at least as long as the circumferential length of the photosensitive drum for the corresponding color (Step S804).

When one or more of the inter-image distances dy, dm, dc, and dk is shorter than the circumferential length of the photosensitive drum for the corresponding color (Step S804: No), the controller 60 performs image noise prediction processing in order to predict whether or not image noise will occur in an image of the next page due to residual charge in the photosensitive drum (Step S805). Note that the image noise prediction processing is explained further below. During the image noise prediction processing, when the controller 60 judges that image noise will occur in the image of the next page (Step S806: Yes), the controller 60 sets length of an inter-sheet period such that, for each of the colors, the inter-image distance becomes at least as long as the circumferential length of the photosensitive drum for the corresponding color (Step S807).

Length of the inter-sheet period can for example be calculated as explained below. For each of one or more colors for which the inter-image distance is shorter than the circumferential length of the corresponding photosensitive drum, an extension time is calculated which is necessary in order to increase inter-sheet distance by an amount equivalent to a difference between the circumferential length of the photosensitive drum and the inter-image distance. The extension time is calculated by dividing the aforementioned difference by rotational speed of the circumference of the corresponding photosensitive drum. Note that rotational speed of the circumference of the photosensitive drum for each of the colors is stored in advance, for example in the ROM 603.

Length of the inter-sheet period can subsequently be calculated by adding the extension time to a default time. Note that in a situation in which different extension times are calculated for different colors, length of the inter-sheet period can be calculated by adding a greatest extension time, among the calculated extension times, to the default time.

Alternatively, the extension time used in order to calculate length of the inter-sheet period may be an amount of time which is fixed regardless of the aforementioned difference. For example, an extension time for the inter-sheet period when inter-image distance is a minimum value (i.e., when inter-image distance is equal to inter-sheet distance) may be calculated in advance in the same way as described above, and length of the inter-sheet period may be calculated by adding the extension time which is calculated in advance to the default time.

On the other hand, when all of the inter-image distances dy, dm, dc, and dk are at least as long as the circumferential length of the photosensitive drum for the corresponding color (Step S804: Yes), or when image noise is predicted to not occur in the image of the next page during image noise prediction processing (Step S806: No), the controller 60 sets the default time as length of the inter-sheet period (Step S808).

Next, the controller 60 causes execution of light exposure scanning on the image carrier surface of the photosensitive drum for each of the Y, M, C, and K colors, based on image data of the corresponding pages in order, but leaving the inter-sheet period unused for light exposure scanning. Thus, the controller 60 executes a printing process for the corresponding pages in order, forming images based on the image data thereof, and causes charge to be applied to the image carrier surface of the photosensitive drum for each of the Y, M, C, and K colors during the inter-sheet period, in order to remove residual charge from the photosensitive drum (Step S809).

When the next page (page k+1) is not a final page (Step S810: No), the controller 60 increases variable k by one (Step S811), and subsequently repeats processing from Step S803.

Figure 9:
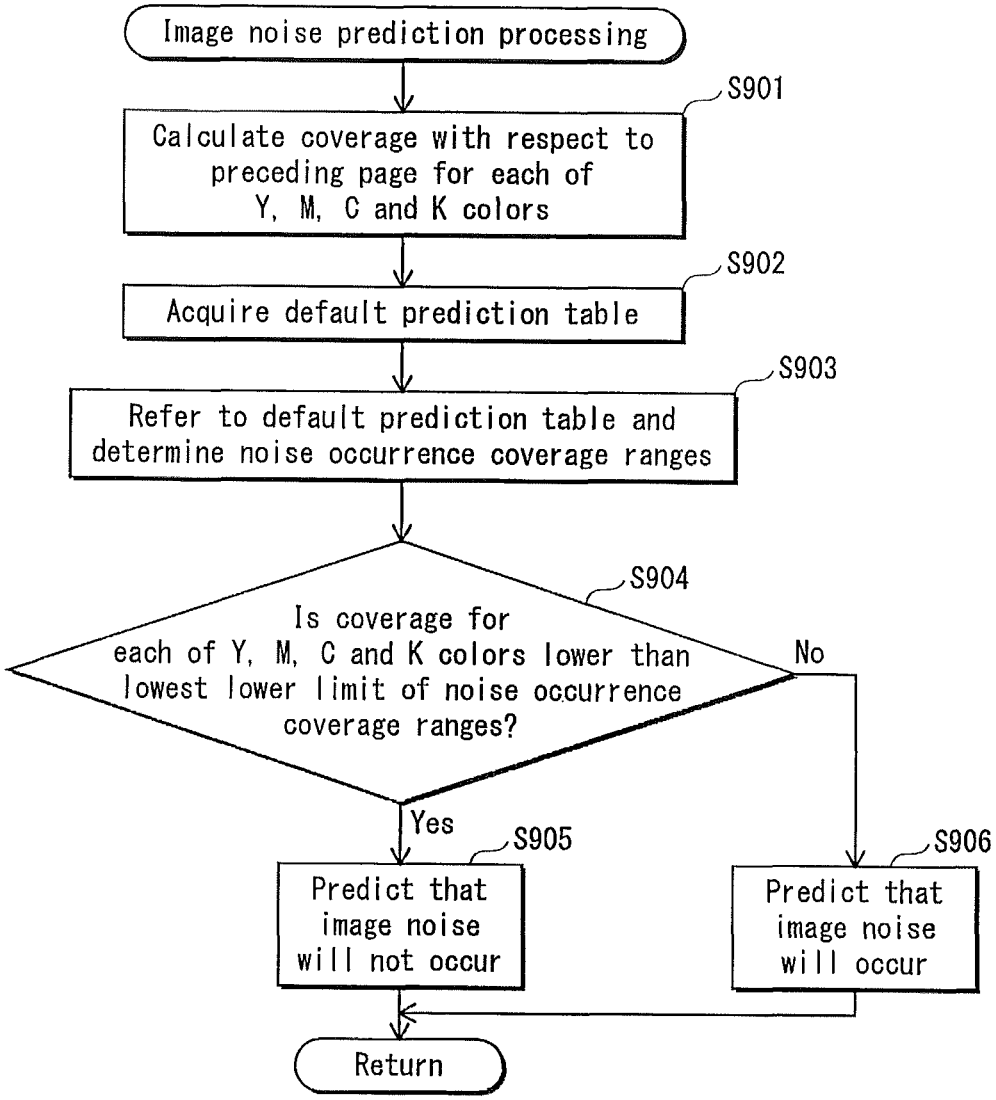
FIG. 9 is a flowchart illustrating image noise prediction processing.

The following explains the image noise prediction processing. FIG. 9 is a flowchart illustrating operation during the image noise prediction processing. The controller 60 calculates coverage of the preceding page for each of the Y, M, C, and K colors (Step S901), and acquires the default prediction table from the image noise prediction table storage unit 611 (Step S902). The controller 60 determines noise occurrence coverage ranges by referring to the default prediction table (Step S903).

Next, the controller 60 judges whether coverage for all of the Y, M, C, and K colors is lower than a lowest value (herein, referred to as a lowest lower limit) among lower limits of the noise occurrence coverage ranges which are determined (Step S904). For example, in the case of a relationship between coverage range and image noise threshold value illustrated in FIG. 7A for when absolute humidity N is in the range "N≤3", the controller 60 determines that "40≤P<60", "60≤P<80" "80≤P<100", and "P=100" are each an noise occurrence coverage range, and thus that a lowest lower limit is 40%.

When coverage for all of the Y, M, C, and K colors is lower than the lowest lower limit (Step S904: Yes), the controller 60 predicts that image noise will not occur in the image of the next page (Step S905). When coverage for all of the Y, M, C, and K colors is not lower than the lowest lower limit (i.e., when coverage for one or more colors is greater than or equal to the lowest lower limit) (Step S904: No), the controller 60 predicts that image noise will occur in the image of the next page (Step S906).

According to the image formation processing described above, during an image formation operation a prediction is performed as to whether or not image noise will occur in an image of a next page after a preceding page due to residual charge in a photosensitive drum. Also, when image noise is predicted to not occur, length of an inter-sheet period is set as a default time in order that image formation productivity is not reduced, whereas when image noise is predicted to occur, the inter-sheet period is extended relative to the default time in order that inter-image distance between the preceding page and the next page is extended to be at least as long as circumferential length of the photosensitive drum.

An effect of the above is that when there is no significant possibility that image noise will occur, reduction in image formation productivity can be prevented by not extending the inter-sheet period, whereas when there is a significant possibility that image noise will occur, occurrence of image noise during the image formation operation can be prevented by extending the inter-sheet period.

Modified Examples

The present invention is explained based on the above embodiment, but the present invention is of course not limited to the embodiment. For example, the present invention may alternatively be implemented as explained in any of the following modified examples.

(1) In the embodiment, the image noise prediction table used during image noise prediction processing is the default prediction table, and thus only coverage is taken into account when predicting whether or not image noise will occur. Alternatively, humidity, usage amount of the photosensitive drums, or both humidity and usage amount may also be taken into account during image noise prediction processing.

Figure 10:
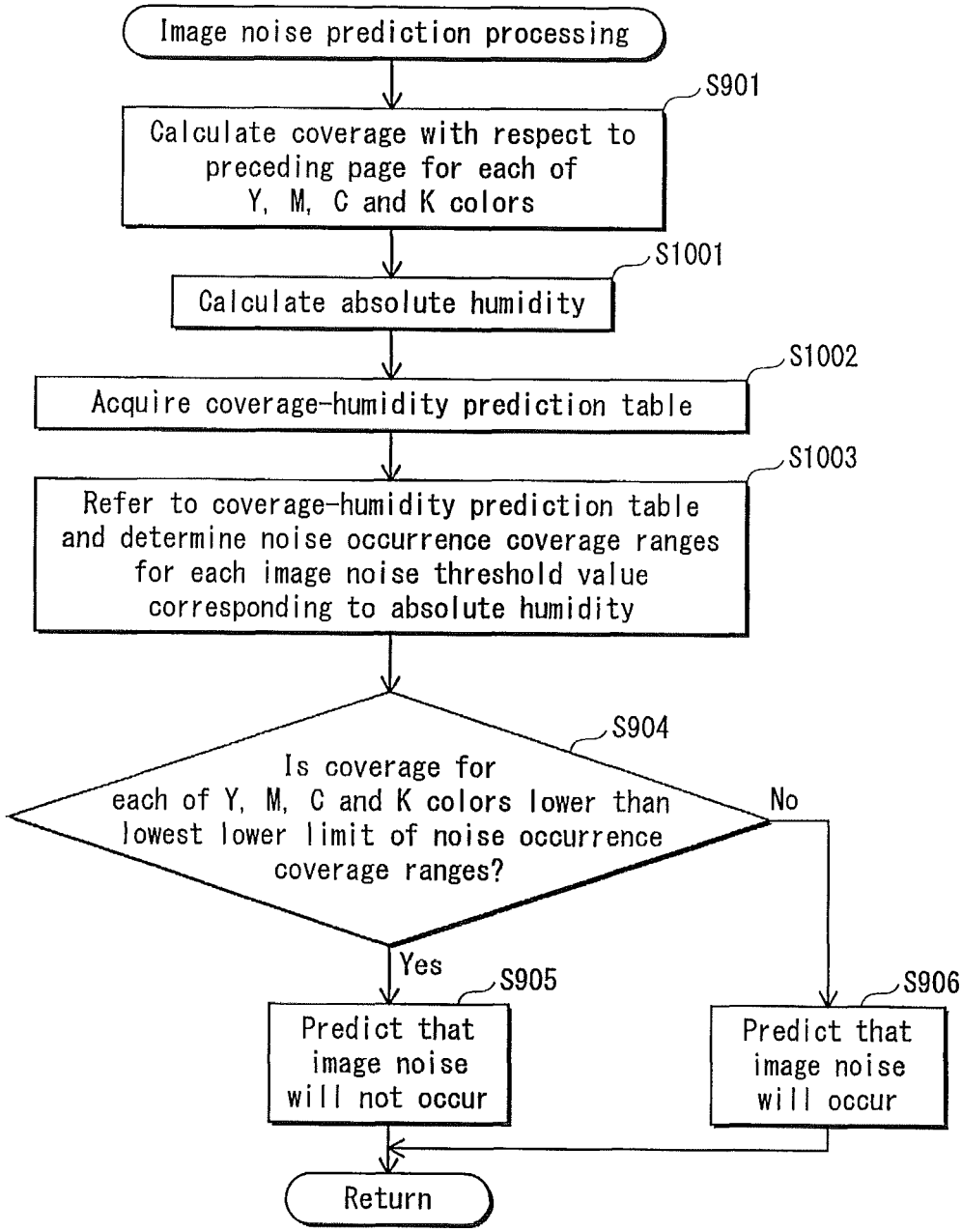
FIG. 10 is a flowchart illustrating a first modified example of image noise prediction processing.

For example, the image noise prediction table stored in the image noise prediction table storage unit 611 may alternatively be a coverage-humidity prediction table, and image noise prediction processing illustrated in FIG. 9 may be modified as illustrated in FIG. 10. For example, the image noise prediction table illustrated in FIG. 7A can be used as the coverage-humidity prediction table.

FIG. 10 illustrates a first modified example of image noise prediction processing. Note that steps which are the same as in image noise prediction processing illustrated in FIG. 9 for the embodiment are labeled using the same reference signs in FIG. 10 and explanation thereof is omitted. The following explanation focuses on differences compared to the image noise prediction processing illustrated in FIG. 9. Once processing in Step S901 is complete, the controller 60 acquires a current internal temperature from the internal temperature sensor 36 and a current internal relative humidity from the internal humidity sensor 37, and uses the absolute humidity calculation table to calculate a current internal absolute humidity from the current internal temperature and the current internal relative humidity (Step S1001).

Next, the controller 60 acquires the coverage-humidity prediction table from the image noise prediction table storage unit 611 (Step S1002). The controller 60 determines a noise occurrence coverage range for each image noise threshold value corresponding to the absolute humidity which is calculated by referring to the coverage-humidity prediction table (Step S1003), and proceeds to processing in Step S904.

Through the above configuration, a lowest among lower limits of the noise occurrence ranges determined in Step S1003 increases in accordance with increasing absolute humidity which is calculated, and thus the lowest lower limit which is used as a judgment reference for coverage in order to predict whether image noise will occur, is set as a higher value.

For example, when the image noise prediction table illustrated in FIG. 7A is used as the coverage-humidity prediction table and the absolute humidity is calculated to be 3 g/m$^3$, a lowest among lower limits of noise occurrence coverage ranges illustrated in FIG. 7A is 40%, and thus the lowest lower limit is set as 40%.

On the other hand, when the absolute humidity is calculated to be 9 g/m$^3$, a lowest among lower limits of noise occurrence coverage ranges illustrated in FIG. 7A is 80%, and thus the lowest lower limit is set as 80%. In a further example, when the absolute humidity is calculated to be 14 g/m$^3$, a lowest among lower limits of noise occurrence coverage ranges illustrated in FIG. 7A is 100%, and thus the lowest lower limit is set as 100%.

In the above configuration, influence of absolute humidity on occurrence of image noise (i.e., image noise occurs less readily when absolute humidity is high) is taken into account when predicting whether or not image noise will occur. The above configuration therefore enables more accurate prediction compared to a configuration in which only coverage is taken into account when predicting whether image noise will occur. As a consequence, the above configuration prevents erroneous predictions which cause reduced image formation productivity due to the inter-sheet period being extended unnecessarily, and thereby improves image formation productivity.

Figure 11:
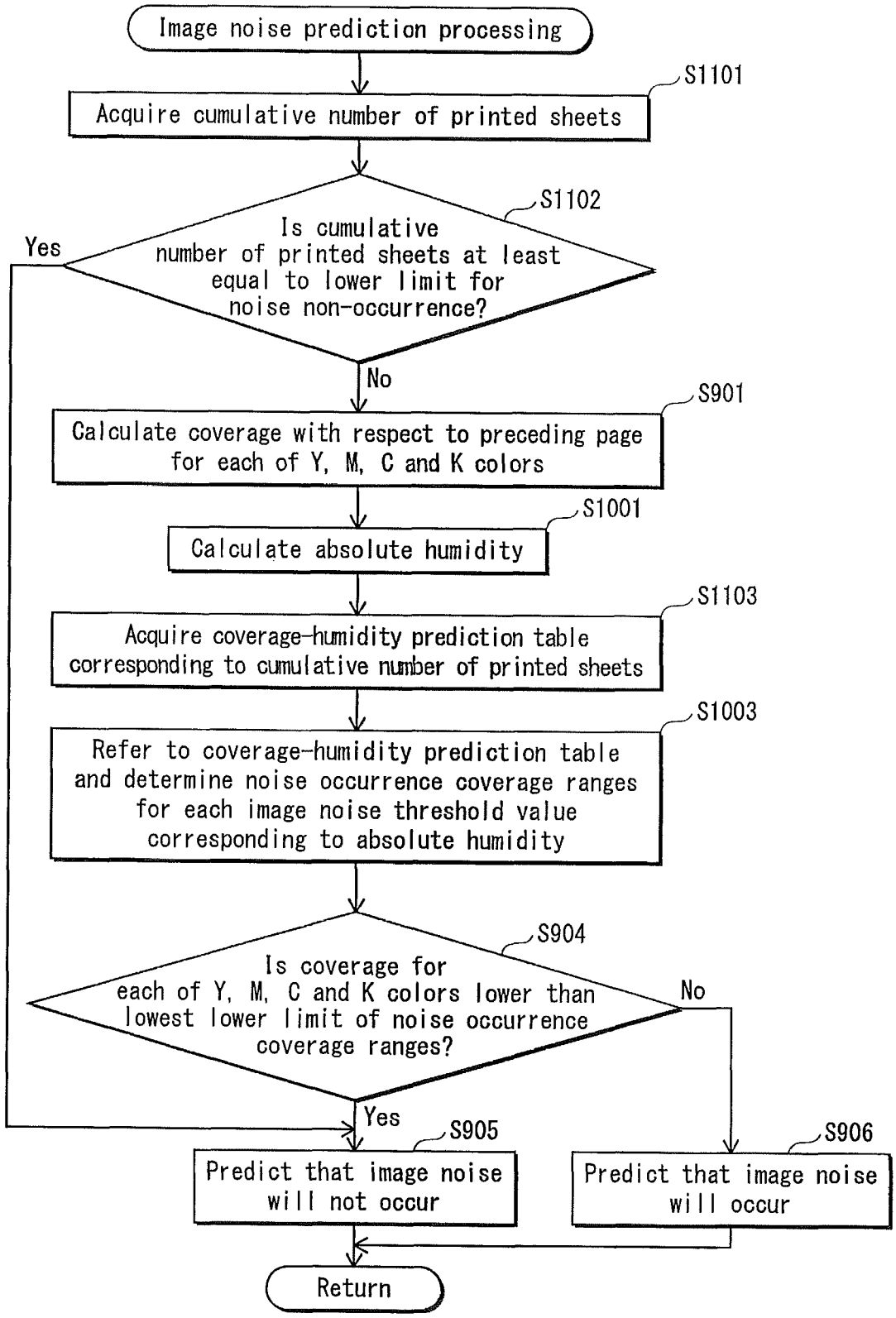
FIG. 11 is a flowchart illustrating a second modified example of image noise prediction processing.

In the modified example described above, alternatively a lower limit for noise non-occurrence and a plurality of coverage-humidity prediction tables corresponding to different usage amounts of the photosensitive drums may be stored in the image noise prediction table storage unit 611, and the image noise prediction processing in FIG. 10 may be modified as illustrated in FIG. 11.

For example, the image noise prediction tables in FIGS. 7A and 7B can be used as the plurality of coverage-humidity prediction tables which are stored in the image noise prediction table storage unit 611. FIG. 11 illustrates a second modified example of image noise prediction processing. Note that steps which are the same as in image noise prediction processing illustrated in FIG. 10 are labeled using the same reference signs in FIG. 11 and explanation thereof is omitted. The following explanation focuses on differences compared to the image noise prediction processing in FIG. 10.

The controller 60 acquires a cumulative number of printed sheets based on a current count value of the cumulative printed sheet number counter 609 (Step S1101), and judges whether the cumulative number of printed sheets which is acquired is at least equal to the lower limit for noise non-occurrence stored in the image noise prediction table storage unit 611 (Step S1102).

When judging that the cumulative number of printed sheets is at least equal to the lower limit for noise non-occurrence (Step S1102: Yes), the controller 60 proceeds to processing in Step S905. On the other hand, when judging that the cumulative number of printed sheets is lower than the lower limit for noise non-occurrence (Step S1102: No), the controller 60 performs processing in Steps S901 and S1001, acquires a coverage-humidity prediction table from the image noise prediction table storage unit 611 which corresponds to the cumulative number of printed sheets (Step S1103), and subsequently proceeds to processing in Step S1003.

Figure 12:
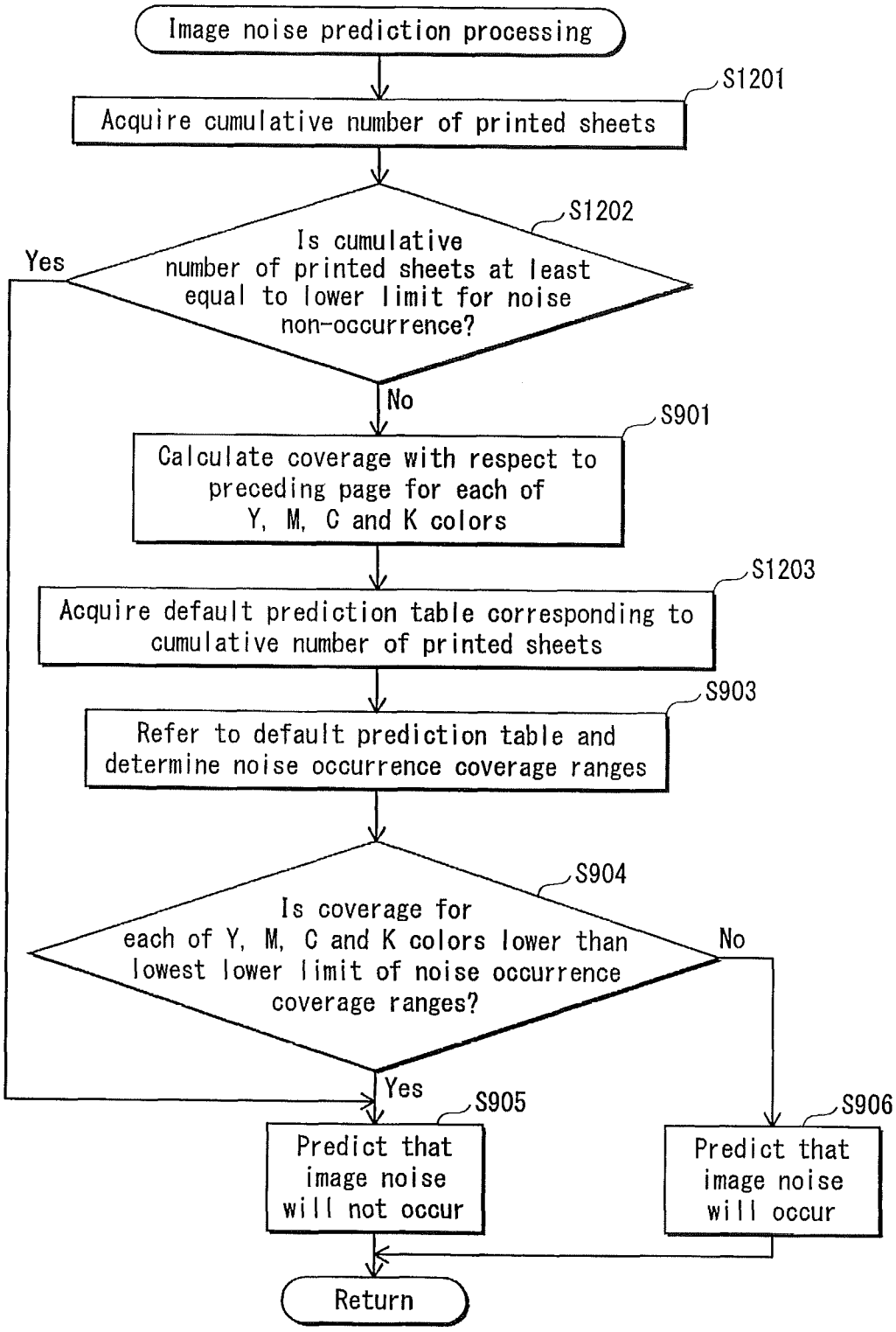
FIG. 12 is a flowchart illustrating a third modified example of image noise prediction processing.

Note that image noise prediction processing relating to the embodiment which is illustrated in FIG. 9 may also be modified in the same way as illustrated in FIG. 11. In other words, a lower limit for noise non-occurrence and a plurality of default prediction tables corresponding to different usage amounts of the photosensitive drums may be stored in the image noise prediction table storage unit 611, and the image noise prediction processing in FIG. 9 may be modified as illustrated in FIG. 12.

For example, relationships between coverage range and image noise threshold value illustrated in FIGS. 7A and 7B for when absolute humidity N is in the range "N≤3" may be included in the plurality of default prediction tables stored in the image noise prediction table storage unit 611. FIG. 12 illustrates a third modified example of image noise prediction processing. Note that steps which are the same as in image noise prediction processing illustrated in FIG. 9 are labeled using the same reference signs in FIG. 12 and explanation thereof is omitted. The following explanation focuses on differences compared to the image noise prediction processing in FIG. 9.

The controller 60 acquires a cumulative number of printed sheets based on a current count value of the cumulative printed sheet number counter 609 (Step S1201), and judges whether the cumulative number of printed sheets which is acquired is at least equal to the lower limit for noise non-occurrence stored in the image noise prediction table storage unit 611 (Step S1202).

When judging that the cumulative number of printed sheets is at least equal to the lower limit for noise non-occurrence (Step S1202: Yes), the controller 60 proceeds to processing in Step S905. On the other hand, when judging that the cumulative number of printed sheets is lower than the lower limit for noise non-occurrence (Step S1202: No), the controller 60 performs processing in Step S901, acquires a default prediction table from the image noise prediction table storage unit 611 which corresponds to the cumulative number of printed sheets (Step S1203), and subsequently proceeds to processing in Step S903.

In the modified example described above, respective usage amounts of the photosensitive drums for each of the colors are acquired by counting a same cumulative number of printed sheets for each of the photosensitive drums, but alternatively respective usage amounts of the photosensitive drums for each of the colors may be acquired through an individual counting process for each of the photosensitive drums. For example, usage amount of the photosensitive drum for each of the colors can be counted individually by counting operation time of a drive motor of the photosensitive drum for the corresponding color.

In such a configuration, processing in Step S1102 of FIG. 11 and Step S1202 of FIG. 12 may be performed by judging whether a smallest usage amount among the usage amounts which are acquired is at least equal to a lower limit for noise non-occurrence (for example, a lower limit for noise non-occurrence calculated with respect to operation time of a drive motor). Also, processing in Step S1103 of FIG. 11 and Step S1203 of FIG. 12 may be performed by acquiring image noise prediction tables (i.e., coverage-humidity prediction tables or default prediction tables) corresponding to the respective usage amounts of the photosensitive drums, and judgment in Step S904 may be performed with respect to coverage of each color using a corresponding one of the image noise prediction tables.

In the above configuration, influence of usage amount of a photosensitive drum on occurrence of image noise (i.e., image noise occurs less readily when usage amount of the photosensitive drum is high) is taken into account when predicting whether or not image noise will occur. The above configuration therefore enables more accurate prediction compared to a configuration in which only coverage is taken into account when predicting whether image noise will occur, or a configuration in which only coverage and humidity are taken into account when predicting whether image noise will occur. As a consequence, the above configuration prevents erroneous predictions which cause reduced image formation productivity due to the inter-sheet period being extended unnecessarily, and thereby improves image formation productivity.

(2) in the embodiment, during image noise prediction processing, prediction is performed as to whether or not image noise will occur using noise occurrence coverage ranges, but alternatively prediction as to whether image noise will occur may be performed such as to also take into account image noise threshold values. More specifically, image formation processing illustrated in FIG. 8 for the embodiment may be modified as illustrated in FIG. 13.

In the present modified example, the controller 60 counts, for each of the noise occurrence coverage ranges, a cumulative number of times that coverage calculated for a certain color is at least equal to a lower limit of the noise occurrence coverage range. The controller 60 performs the above for each of the Y, M, C, and K colors. The aforementioned cumulative number of times is referred to below as a cumulative image noise number.

Figure 13:
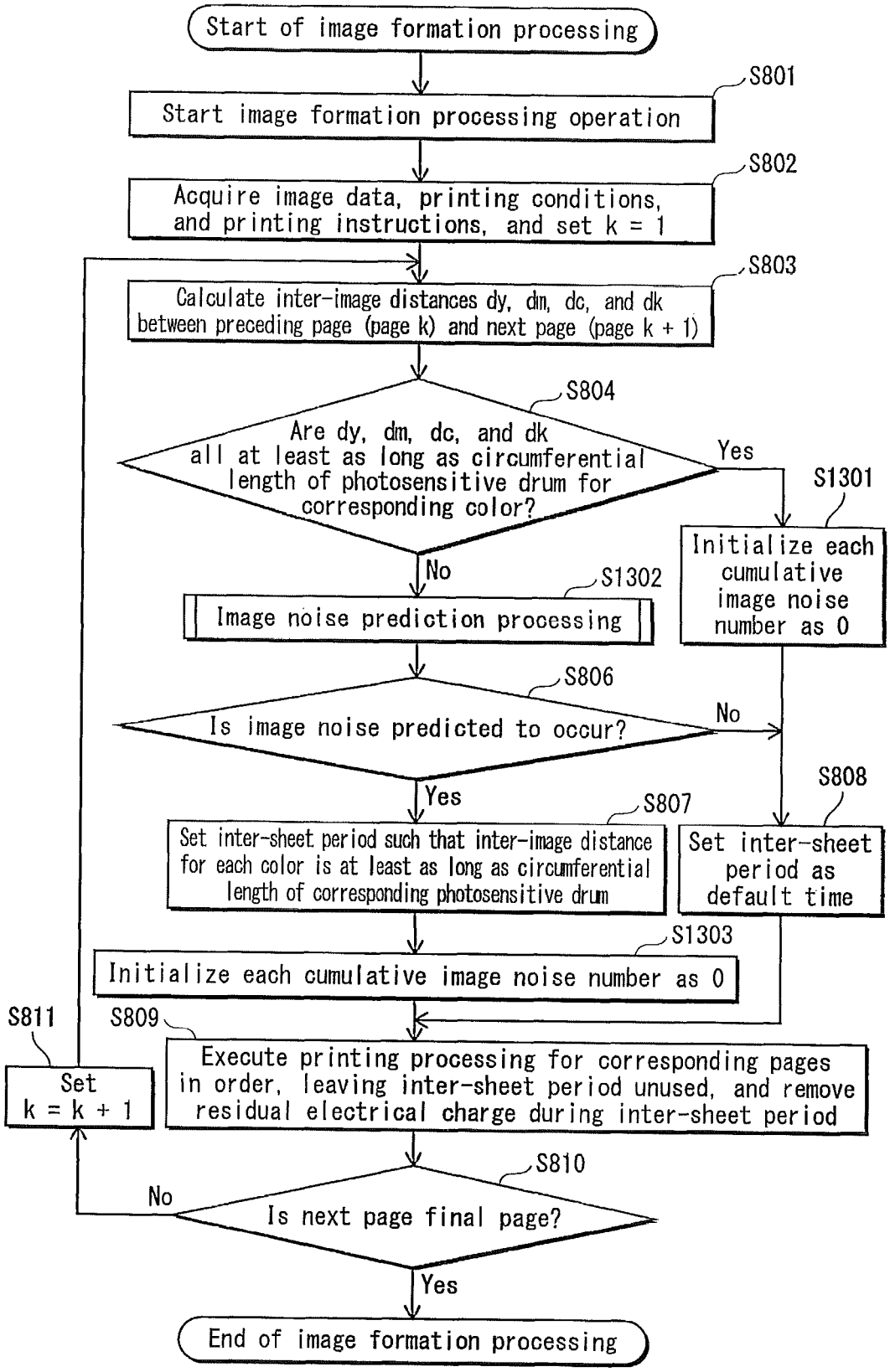
FIG. 13 is a flowchart illustrating a first modified example of image formation processing.

FIG. 13 illustrates a first modified example of image formation processing. Note that steps which are the same as in image formation processing illustrated in FIG. 8 for the embodiment are labeled using the same reference signs in FIG. 13 and explanation thereof is omitted. The following explanation focuses on differences compared to the image formation processing illustrated in FIG. 8. When the controller 60 judges affirmatively in Step S804 (Step S804: Yes), the controller 60 initializes each cumulative image noise number as zero (Step S1301), and proceeds to processing in Step S808.

The controller 60 also initializes each cumulative image noise number as zero after performing processing in Step S807 (Step S1303).

Figure 14:
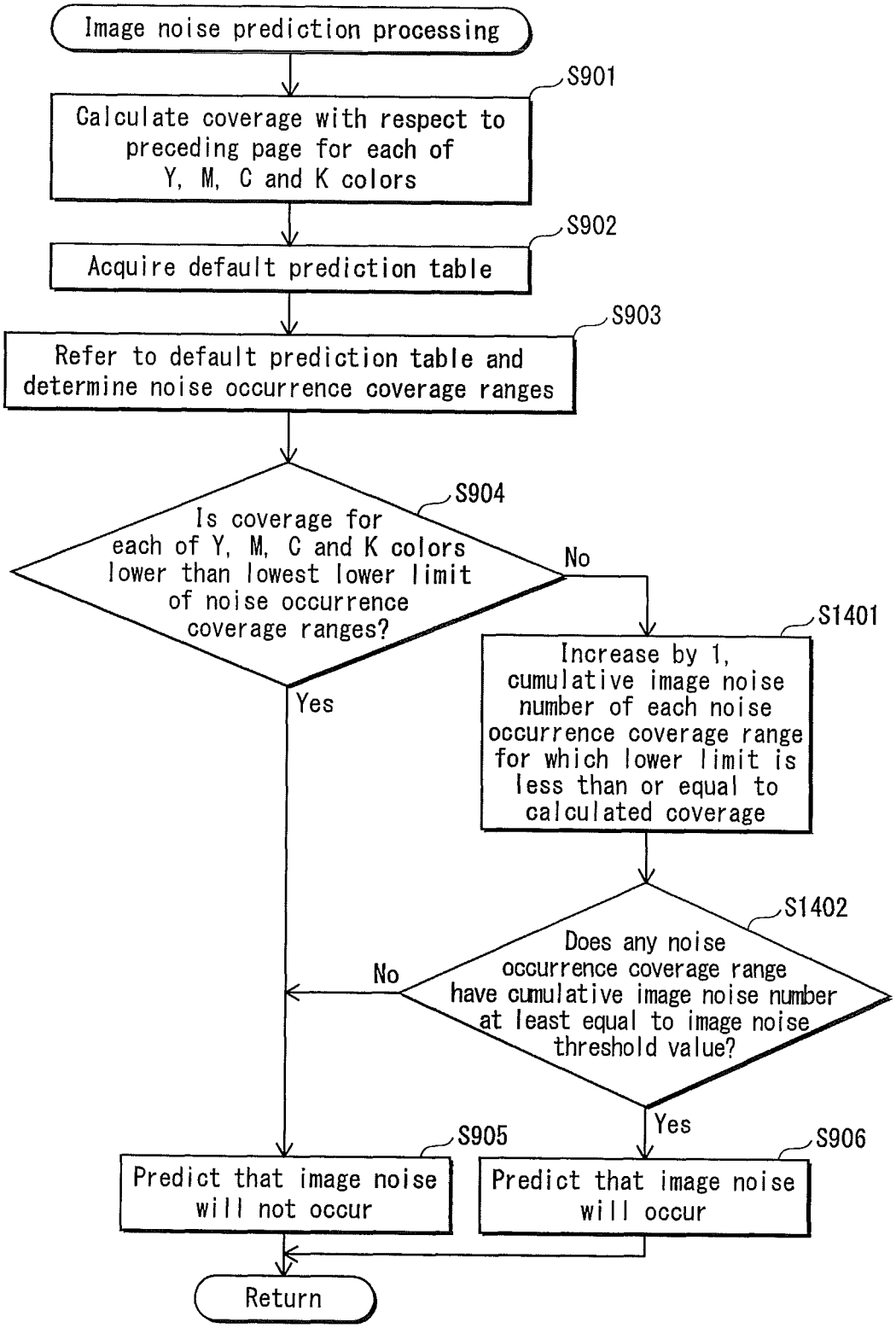
FIG. 14 is a flowchart illustrating a fourth modified example of image noise prediction processing.

The controller 60 performs image noise prediction processing illustrated in FIG. 14 instead of image noise prediction processing illustrated in FIG. 9 (Step S1302). FIG. 14 illustrates a fourth modified example of image noise prediction processing. Note that steps which are the same as in image noise prediction processing illustrated in FIG. 9 for the embodiment are labeled using the same reference signs in FIG. 14 and explanation thereof is omitted. The following explanation focuses on differences compared to the image noise prediction processing illustrated in FIG. 9.

When the controller 60 judges negatively in Step S904 (Step S904: No), with respect to each color for which coverage is at least equal to the lowest lower limit, the controller 60 increases the cumulative image noise number by one for each noise occurrence coverage range, among the noise occurrence coverage ranges determined in Step S903, for which the lower limit thereof is less than or equal to coverage for the color (i.e., coverage is greater than or equal to the lower limit of the noise occurrence coverage range) (Step S1401).

Next, the controller 60 judges whether, among the noise occurrence coverage ranges for which the cumulative image noise number was increased in Step S1401, there is an noise occurrence coverage range for which the cumulative image noise number is at least equal to the image noise threshold value for the noise occurrence coverage range (Step S1402). When the controller 60 judges affirmatively in Step S1402 (Step S1402: Yes), the controller 60 proceeds to processing in Step S906. On the other hand, when the controller 60 judges negatively in Step S1402 (Step S1402: No), the controller 60 proceeds to processing in Step S905.

Note that the modified example described above can also be applied in the same way to the modified example explained in section (1).

Through the configuration described above, even when coverage is at least equal to the lowest lower limit, control is performed such that the inter-sheet period is not extended unless at least one cumulative image noise number has reached a corresponding image noise threshold value (i.e., unless the cumulative image noise number has reached a threshold value at which image noise occurs). Therefore, compared to a configuration in which prediction as to whether or not image noise will occur is performed using only the lowest lower limit as a reference, a number of times that the inter-sheet period is extended can be reduced, and thereby image formation productivity can be improved.

(3) During image formation processing in the embodiment, when image noise is predicted to occur for the next page after the preceding page, length of the inter-sheet period is set such that inter-image distance for each of the Y, M, C, and K colors is at least as long as the circumferential length of the photosensitive drum for the corresponding color (Step S807), regardless of a type of image of the next page. Image noise is more noticeable in an image with gradation such as a half tone image and is less noticeable in an image which is largely binary without gradation such as a text image. As a consequence, when the image of the next page is a text image, length of the inter-sheet period may alternatively be set as the default time (Step S808).

Figure 15:
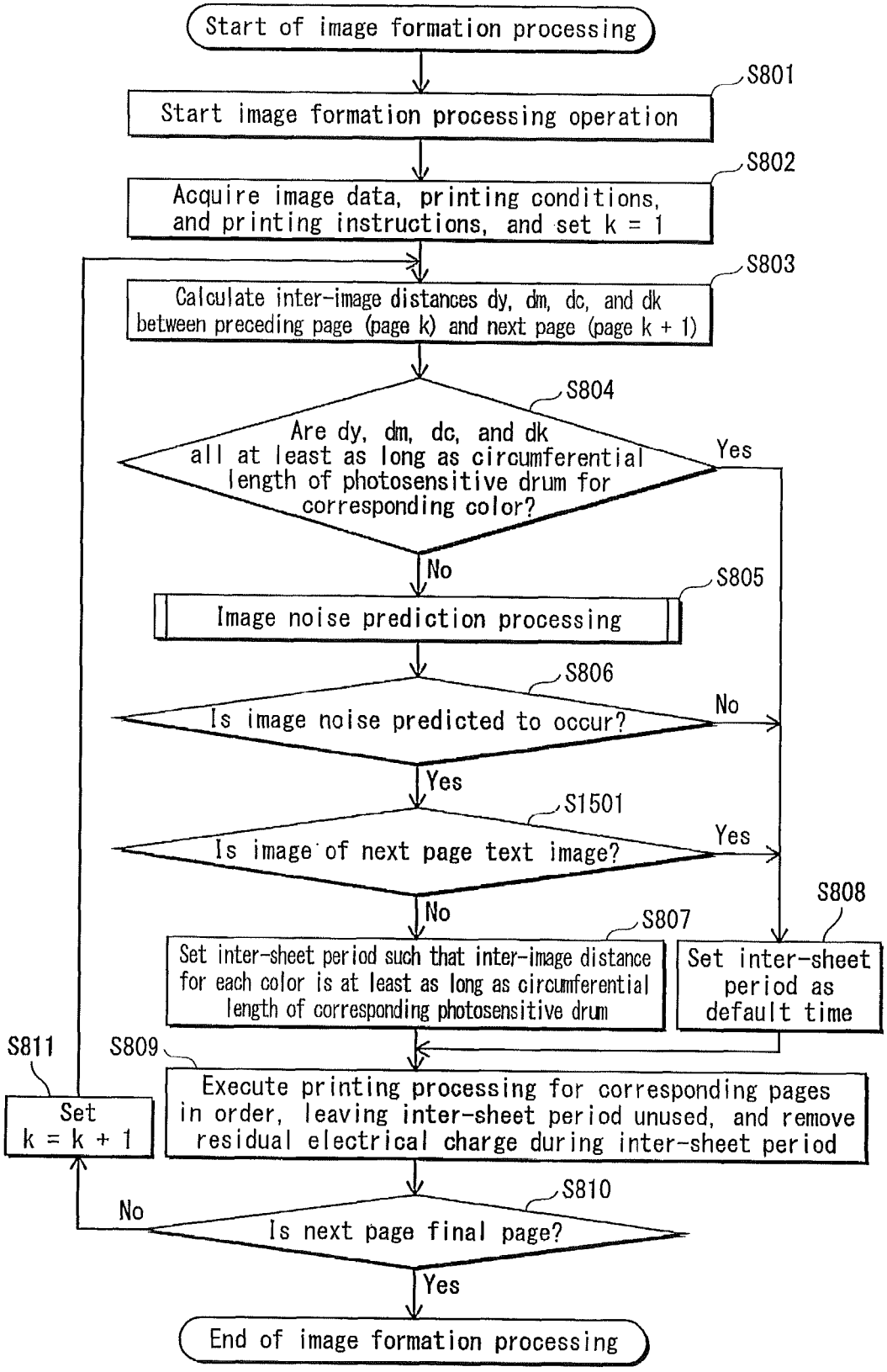
FIG. 15 is a flowchart illustrating a second modified example of image formation processing.

More specifically, image formation processing in FIG. 8 may be modified as illustrated in FIG. 15. FIG. 15 illustrates a second modified example of image formation processing. Note that steps which are the same as in image formation processing illustrated in FIG. 8 for the embodiment are labeled using the same reference signs in FIG. 15 and explanation thereof is omitted. The following explanation focuses on differences compared to the image formation processing in FIG. 8.

When judging affirmatively in Step S806 (Step S806: Yes), the controller 60 judges whether an image of the next page after the preceding page is a text image based on image data of the next page (Step S1501). When judging that the image of the next page is not a text image (Step S1501: No), the controller 60 proceeds to processing in Step S807. On the other hand, when judging that the image of the next page is a text image (Step S1501: Yes), the controller 60 proceeds to processing in Step S808. Note that the present modified example can be applied in the same way to the modified examples described in sections (1) and (2).

Through the configuration described above, when the image of the next page is a text image in which image noise is not easily noticeable even if image noise occurs, the inter-sheet period is controlled so as not to be extended, even when there is a significant possibility of image noise occurring in the next page. As a consequence, the inter-sheet period is not unnecessarily extended, enabling performance of image formation for the next page to start more quickly, and thereby improving image formation productivity.

SUMMARY

As disclosed above, one aspect of the present invention is an image formation apparatus performing light exposure scanning based on image data of a target page, thereby forming a toner image on a charged image carrier surface of a photosensitive body, applying electrical charge to the image carrier surface, while rotating the photosensitive body, in order to remove residual charge from the photosensitive body, during a period between completion of the light exposure scanning and commencement of light exposure scanning based on image data of a next page, and performing a first control on rotation distance of a circumference of the photosensitive body during the period such that the rotation distance is a predetermined distance that is shorter than circumferential length of the photosensitive body, the image formation apparatus including: a coverage calculation unit configured to calculate, for the target page, a coverage value indicating surface area of a toner deposition region as a proportion of surface area of an image formation region of the target page; a prediction unit configured to, when an inter-image distance between a trailing end of an image of the target page in terms of a sub-scanning direction and a leading end of an image of the next page in terms of the sub-scanning direction is shorter than the circumferential length of the photosensitive body, perform a prediction as to whether or not image noise will occur in the image of the next page, based on the coverage value calculated for the target page; and a sheet interval control unit configured to, upon the prediction unit predicting that image noise will occur, suspend the first control and perform a second control on the rotation distance of the circumference of the photosensitive body during the period such that the inter-image distance is extended to be at least as long as the circumferential length of the photosensitive body.

In the image formation apparatus described above, the prediction unit may predict that image noise will occur when the coverage value is greater than or equal to a coverage threshold value. Alternatively, the prediction unit may predict that image noise will occur when a cumulative number of times that the coverage value is greater than or equal to a coverage threshold value, equals or exceeds a predetermined number of times.

The image formation apparatus described above may further include: a measurement unit configured to measure an internal temperature and an internal humidity; and a humidity calculation unit configured to calculate an absolute humidity based on measurement results of the measurement unit, wherein the prediction unit may perform the prediction further based on the absolute humidity. The prediction unit may predict that image noise will occur when the coverage value is greater than or equal to a coverage threshold value, and the coverage threshold value may be set in accordance with the absolute humidity such that the coverage threshold value increases in accordance with increase in the absolute humidity. Alternatively, the prediction unit may predict that image noise will occur when a cumulative number of times that the coverage value is greater than or equal to a coverage threshold value, equals or exceeds a predetermined number of times, and the coverage threshold value may be set in accordance with the absolute humidity such that the coverage threshold value increases in accordance with increase in the absolute humidity. The coverage threshold value may be 40% or greater.

The image formation apparatus described above may further include a usage amount acquisition unit configured to acquire an indicator value indicating a usage amount of the photosensitive body, wherein the prediction unit may perform the prediction further based on the usage amount indicated by the indicator value. The photosensitive body may include a protective layer at an outermost surface thereof and may include a charge transport layer as a layer directly inwards of the protective layer.

Through the configuration described above, when the inter-image distance is shorter than the circumferential length of the photosensitive body, prediction as to whether image noise will occur in the image of the next page is performed based on the coverage value calculated for the image of the target image. When image noise is predicted to occur, the image noise is prevented through the second control by controlling the rotation distance of the circumference of the photosensitive body during the period between light exposure scanning being completed for the target page and light exposure scanning commencing for the next page (i.e., a distance equivalent to an interval between successive sheets). The aforementioned control is performed such that the inter-image distance, which is equivalent to a distance between the trailing end of the image of the target page in terms of the sub-scanning direction and the leading end of the image of the next page in terms of the sub-scanning direction, is extended to be at least as long as the circumferential length of the photosensitive body.

An effect of the above configuration is that when there is no significant possibility of image noise occurring, the interval between sheets (i.e., the inter-sheet distance) is not unnecessarily extended. In other words, the interval between successive sheets is not extended such that the inter-image distance is at least as long as the circumferential length of the photosensitive body. Therefore, in the situation described above, image formation can be started more quickly for the next page, thereby improving image formation productivity. On the other hand, when there is a significant possibility of image noise occurring, the image noise is prevented by controlling the interval between successive sheets such that the inter-image distance is extended to be at least as long as the circumferential length of the photosensitive body, thereby ensuring that residual charge is sufficiently removed from the photosensitive body.

The prediction unit may predict that image noise will not occur when the usage amount indicated by the indicator value is greater than or equal to a threshold value.

Through the configuration described above, image noise is predicted not to occur when the usage amount of the photosensitive body is greater than or equal to the threshold value, and the interval between successive sheets is controlled to be shorter than the circumferential length of the photosensitive body. An effect of the above configuration is that when the usage amount of the photosensitive body has reached a level at which there is no significant possibility of image noise occurring, the interval between successive sheets is not unnecessarily extended. Therefore, in the situation described above, image formation can be started more quickly for the next page, thereby improving image formation productivity.

The image formation apparatus described above may further include a judgment unit configured to judge whether the image of the next page is a text image, wherein when the prediction unit predicts affirmatively and the judgment unit judges affirmatively, the sheet interval control unit may release suspension of the first control and may suspend the second control.

Through the configuration described above, when the image of the next page is a text image in which image noise is not easily noticeable, the interval between successive sheets is controlled to be shorter than the circumferential length of the photosensitive body, even when there is a significant possibility of image noise occurring in the next page. An effect of the above configuration is that the aforementioned interval, during which residual charge is removed from the photosensitive body, is not unnecessarily extended in a situation in which a problem does not occur even if the interval between successive sheets is short. Therefore, in the situation described above, image formation can be started more quickly for the next page, thereby improving image formation productivity.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image formation apparatus performing light exposure scanning based on image data of a target page, thereby forming a toner image on a charged image carrier surface of a photosensitive body, applying electrical charge to the image carrier surface, while rotating the photosensitive body, in order to remove residual charge from the photosensitive body, during a period between completion of said light exposure scanning and commencement of light exposure scanning based on image data of a next page, and performing a first control on rotation distance of a circumference of the photosensitive body during the period such that the rotation distance is a predetermined distance that is shorter than circumferential length of the photosensitive body, the image formation apparatus comprising:

a coverage calculation unit configured to calculate, for the target page, a coverage value indicating surface area of a toner deposition region as a proportion of surface area of an image formation region of the target page;

a prediction unit configured to, when an inter-image distance between a trailing end of an image of the target page in terms of a sub-scanning direction and a leading end of an image of the next page in terms of the sub-scanning direction is shorter than the circumferential length of the photosensitive body, perform a prediction as to whether or not image noise will occur in the image of the next page, based on the coverage value calculated for the target page; and a sheet interval control unit configured to, upon the prediction unit predicting that image noise will occur, suspend the first control and perform a second control on the rotation distance of the circumference of the photosensitive body during the period such that the inter-image distance is extended to be at least as long as the circumferential length of the photosensitive body.

2. The image formation apparatus of claim 1, wherein the prediction unit predicts that image noise will occur when the coverage value is greater than or equal to a coverage threshold value.

3. The image formation apparatus of claim 1, wherein the prediction unit predicts that image noise will occur when a cumulative number of times that the coverage value is greater than or equal to a coverage threshold value, equals or exceeds a predetermined number of times.

4. The image formation apparatus of claim 1, further comprising a measurement unit configured to measure an internal temperature and an internal humidity; and a humidity calculation unit configured to calculate an absolute humidity based on measurement results of the measurement unit, wherein the prediction unit performs the prediction further based on the absolute humidity.

5. The image formation apparatus of claim 4, wherein the prediction unit predicts that image noise will occur when the coverage value is greater than or equal to a coverage threshold value, and the coverage threshold value is set in accordance with the absolute humidity such that the coverage threshold value increases in accordance with increase in the absolute humidity.

6. The image formation apparatus of claim 4, wherein the prediction unit predicts that image noise will occurs when a cumulative number of times that the coverage value is greater than or equal to a coverage threshold value, equals or exceeds a predetermined number of times, and the coverage threshold value is set in accordance with the absolute humidity such that the coverage threshold value increases in accordance with increase in the absolute humidity.

7. The image formation apparatus of claim 1, further comprising a usage amount acquisition unit configured to acquire an indicator value indicating a usage amount of the photosensitive body, wherein the prediction unit performs the prediction further based on the usage amount indicated by the indicator value.

8. The image formation apparatus of claim 7, wherein the prediction unit predicts that image noise will not occur when the usage amount indicated by the indicator value is greater than or equal to a threshold value.

9. The image formation apparatus of claim 1, further comprising a judgment unit configured to judge whether the image of the next page is a text image, wherein when the prediction unit predicts affirmatively and the judgment unit judges affirmatively, the sheet interval control unit releases suspension of the first control and suspends the second control.

10. The image formation apparatus of claim 2, wherein the coverage threshold value is 40% or greater.

11. The image formation apparatus of claim 1, wherein the photosensitive body includes a protective layer at an outermost surface thereof and includes a charge transport layer as a layer directly inwards of the protective layer.

* * * * *